US009533495B2

(12) United States Patent
Mogami

(10) Patent No.: US 9,533,495 B2
(45) Date of Patent: Jan. 3, 2017

(54) NOZZLE ROW DRIVING DATA CONVERSION APPARATUS AND LIQUID DROPLET EJECTING APPARATUS

(71) Applicant: Seiko Epson Corporation, Tokyo (JP)

(72) Inventor: Yoshio Mogami, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/882,543

(22) Filed: Oct. 14, 2015

(65) Prior Publication Data

US 2016/0107439 A1 Apr. 21, 2016

(30) Foreign Application Priority Data

Oct. 16, 2014 (JP) ..... 2014-211449

(51) Int. Cl.
*B41J 2/045* (2006.01)

(52) U.S. Cl.
CPC ..... *B41J 2/04543* (2013.01); *B41J 2/04581* (2013.01); *B41J 2/04588* (2013.01); *B41J 2/04595* (2013.01); *B41J 2/04596* (2013.01)

(58) Field of Classification Search
CPC . B41J 2/04543; B41J 2/04595; B41J 2/04596; B41J 2/04581; B41J 2/04588
See application file for complete search history.

(56) References Cited

U.S. PATENT DOCUMENTS

2006/0290727 A1* 12/2006 Uemura ..... B41J 2/04505 347/14
2008/0218547 A1* 9/2008 Takamiya ..... B41J 2/17509 347/12

FOREIGN PATENT DOCUMENTS

| | | | |
|---|---|---|---|
| JP | 2000-280582 | A | 10/2000 |
| JP | 2003-145726 | A | 5/2003 |
| JP | 2006-187932 | A | 7/2006 |
| JP | 2009-226639 | A | 10/2009 |
| JP | 2011-207115 | A | 10/2011 |

* cited by examiner

*Primary Examiner* — Justin Seo

(57) ABSTRACT

A liquid droplet ejecting apparatus includes (n+m) nozzle rows in each of which a plurality of nozzles through which liquid droplets are ejected onto a printing medium are arranged; a nozzle row driving data generation portion configured to generate n sets of nozzle row driving data for the (n+m) rows of nozzles each for driving a corresponding one of the (n+m) nozzle rows; and a nozzle row driving data conversion portion configured to convert the generated n sets of nozzle row driving data that are associated with the (n+m) rows of nozzle row driving data into (n+m) sets of nozzle row driving data each of which is associated with a corresponding one of the (n+m) rows of nozzle row driving data.

8 Claims, 14 Drawing Sheets

NOZZLE ROW DRIVING DATA CONVERSION APPARATUS AND LIQUID DROPLET EJECTING APPARATUS

BACKGROUND

1. Technical Field

The present invention relates to a nozzle row driving data conversion apparatus and a liquid droplet ejecting apparatus.

2. Related Art

Heretofore, an ink jet printer that forms an image by ejecting liquid droplets (ink droplets) onto the surface of a printing medium has been well known as a liquid droplet ejecting apparatus. This ink jet printer is configured to, in order to form an image on the surface of a printing medium such as paper or cloth, alternately repeat two kinds of operations: one being a transport operation that allows the printing medium to move in a transport direction; the other one being a dot formation operation that allows ink droplets to be ejected through a plurality of nozzles that are formed in a printing head while causing the printing head to perform scanning movement in a scan direction, and thereby intermittently repeatedly form and arrange a plurality of rows of dots (dot rows), which are formed and arranged in the scan direction through one of the repeated dot formation operations, along the transport direction.

With respect to such an ink jet printer, there is a tendency in that, in order to realize high-speed formation of a further high-resolution image, a plurality of printing heads, each including further minute nozzles that are arrayed at a high density on a bottom face thereof, are mounted in the ink jet printer. For example, in JP-A-2011-207115, there is described an example of an ink jet printer, in which four printing heads each including one hundred and eighty nozzles that are arrayed on a bottom face thereof are mounted. This ink jet printer includes, for each of a plurality of printing heads, a head control portion that selectively causes each of driving elements to drive a corresponding one of a plurality of nozzles.

In such an ink jet printer described in JP-A-2011-207115, however, there has been a problem in that, since control circuits for the printing heads (i.e., circuits that drive the printing heads and that are constituted by a unit control circuit and the head control portions) are configured so as to be in accordance with a total number of the printing heads, any further printing head whose existence causes a total number of printing heads including the further printing head to exceed a total number of a series of control circuits each of which is associated with, and controls, a corresponding one of the printing heads cannot be used. In other words, there has been a problem in that, when further printing heads are desired to be mounted, not only the modification related to the head control portions whose total number is increased, but also the modification of the unit control circuit is required.

SUMMARY

The invention can be realized in the following forms or application examples.

Application Example 1

A nozzle row driving data conversion apparatus according to this application example is configured to convert n sets of nozzle row driving data for (n+m) rows of nozzles into (n+m) sets of nozzle row driving data for the (n+m) rows of nozzles.

According to this application example, the nozzle row driving data conversion apparatus converts the n sets of nozzle row driving data for the (n+m) rows of nozzles into (n+m) sets of nozzle row driving data for the (n+m) rows of nozzles. Through the provision of this nozzle row driving data conversion apparatus in a liquid droplet ejecting apparatus, it becomes possible to easily change the number of nozzle rows of the liquid droplet ejecting apparatus. Specifically, it becomes possible to easily replace a liquid droplet ejecting head including n nozzle rows by a liquid droplet ejecting head including (n+m) nozzle rows. Note that each of n and m is a natural number.

Application Example 2

In the nozzle row driving data conversion apparatus according to the above application example, the n sets of nozzle row driving data for the (n+m) rows of nozzles includes nozzle row driving data resulting from dividing m rows of nozzle row driving data into n blocks.

According to this application example, the n sets of nozzle row driving data for the (n+m) rows of nozzles includes nozzle row driving data resulting from dividing m rows of nozzle row driving data into n blocks. Thus, it is possible to generate m sets of nozzle row driving data for m rows of nozzles by combining n blocks of nozzle row driving data for the m rows of nozzles. That is, the nozzle row driving data conversion apparatus is capable of converting the n sets of nozzle row driving data for the (n+m) rows of nozzles into n sets of nozzle row driving data for n rows of nozzles and m sets of nozzle row driving data for m rows of nozzles. Through the provision of the nozzle row driving data conversion apparatus according to this application example into a liquid droplet ejecting apparatus, it becomes possible to use the nozzle row driving data for the (n+m) rows of nozzles with n sets of nozzle row driving data at a stage anterior to the nozzle row driving data conversion apparatus. Accordingly, it becomes possible to easily replace a liquid droplet ejecting head including n nozzle rows by a liquid droplet ejecting head including (n+m) nozzle rows.

Application Example 3

In the nozzle row driving data conversion apparatus according to the above application example, the n sets of nozzle row driving data for the (n+m) rows of nozzles includes nozzle row driving data resulting from dividing each of the (n+m) rows of nozzle row driving data into n blocks.

According to this application example, the n sets of nozzle row driving data for the (n+m) rows of nozzles includes nozzle row driving data resulting from dividing each of the (n+m) rows of nozzle row driving data into n blocks. Thus, it is possible to convert the n sets of nozzle row driving data for the (n+m) rows of nozzles into n sets of driving data for n rows of nozzles and m sets of driving data for m rows of nozzles by combining n blocks of nozzle row driving data for each of the (n+m) rows of nozzles. Through the provision of the nozzle row driving data conversion apparatus according to this application example into a liquid droplet ejecting apparatus, it becomes possible to use the nozzle row driving data for the (n+m) rows of nozzles with n sets of nozzle row driving data at a stage anterior to the nozzle row driving data conversion apparatus. Accordingly, it becomes possible to easily replace a liquid droplet ejecting head including n nozzle rows by a liquid droplet ejecting head including (n+m) nozzle rows.

Application Example 4

In the nozzle row driving data conversion apparatus according to the above application example, the nozzle row driving data conversion apparatus includes a programmable logic device.

According to this application example, since the nozzle row driving data conversion apparatus includes a programmable logic device, it is possible to easily configure the nozzle row driving data conversion apparatus. Moreover, it is possible to easily change the number of the sets of nozzle row driving data. Specifically, through the provision of the nozzle row driving data conversion apparatus according to this application example in a liquid droplet ejecting apparatus, it is possible to flexibly change the number of the nozzle rows included in the liquid droplet ejecting head, that is, it is possible to easily change the values of n and m.

Application Example 5

A liquid droplet ejecting apparatus according to this application example includes (n+m) nozzle rows including a plurality of nozzles through which liquid droplets are ejected onto a printing medium; and a nozzle row driving data conversion portion configured to convert n sets of nozzle row driving data for the (n+m) rows of nozzles, the data being used in driving the nozzle rows, into (n+m) sets of nozzle row driving data for the (n+m) rows of nozzles.

According to this application example, a liquid droplet ejecting apparatus includes (n+m) nozzle rows; and a nozzle row driving data conversion portion configured to convert n sets of nozzle row driving data for the (n+m) rows of nozzles, which is used to drive nozzle rows, into (n+m) sets of nozzle row driving data (n+m) rows of nozzle. Thus, it becomes possible to easily change the number of nozzle rows included in the liquid droplet ejecting apparatus. Specifically, it becomes possible to easily replace a liquid droplet ejecting head including n nozzle rows by a liquid droplet ejecting head including (n+m) nozzle rows.

Application Example 6

In the liquid droplet ejecting apparatus according to the above application example, the n sets of nozzle row driving data for the (n+m) rows of nozzles includes nozzle row driving data resulting from dividing m rows of nozzle row driving data into n blocks.

According to this application example, the n sets of nozzle row driving data for the (n+m) rows of nozzles includes nozzle row driving data resulting from dividing m rows of nozzle row driving data into n blocks. Thus, it is possible to generate m sets of nozzle row driving data for m rows of nozzles by combining n blocks of nozzle row driving data for the m rows of nozzles. That is, the nozzle row driving data conversion portion is capable of converting the n sets of nozzle row driving data for the (n+m) rows of nozzles into two nozzle row driving data including n sets of driving data for n rows of nozzles and m sets of driving data for m rows of nozzles. As a result, in the liquid droplet ejecting apparatus, it becomes possible to use the (n+m) rows of nozzles with the driving data for the n sets of nozzle row driving data at a stage anterior to the nozzle row driving data conversion portion. Accordingly, it becomes possible to easily replace a liquid droplet ejecting head including n nozzle rows by a liquid droplet ejecting head including (n+m) nozzle rows.

Application Example 7

In the liquid droplet ejecting apparatus according to the above application example, the n sets of nozzle row driving data for the (n+m) rows of nozzles includes nozzle row driving data resulting from dividing each of the (n+m) rows of nozzle row driving data into n blocks.

According to this application example, the n sets of nozzle row driving data for the (n+m) rows of nozzles includes nozzle row driving data resulting from dividing each of (n+m) rows of nozzle row driving data into n blocks. Thus, it is possible to convert the n sets of nozzle row driving data for the (n+m) rows of nozzles into two nozzle row driving data including n sets of driving data for n rows of nozzles and m sets of driving data for m rows of nozzles by combining n blocks of nozzle row driving data for each of the (n+m) rows of nozzles. As a result, it becomes possible to use the (n+m) rows of nozzles with the driving data for the n sets of nozzle row driving data at a stage anterior to the nozzle row driving data conversion portion. Accordingly, it becomes possible to easily replace a liquid droplet ejecting head including n nozzle rows by a liquid droplet ejecting head including (n+m) nozzle rows.

Application Example 8

In the liquid droplet ejecting apparatus according to the above application example, the nozzle row driving data conversion portion includes a programmable logic device.

According to this application example, since the nozzle row driving data conversion portion includes a programmable logic device, it is possible to easily configure the nozzle row driving data conversion portion. Moreover, it is possible to easily change the number of the sets of nozzle row driving data. Specifically, in the liquid droplet ejecting apparatus according to this application example, it is possible to flexibly change the number of the nozzle rows included in the liquid droplet ejecting head, that is, it is possible to easily deal with the change of the values of n and m.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments in which the invention is embodied will be described with reference to the drawings. The following embodiments are just embodiments of the invention, and do not limit the invention. In addition, in drawings referred to below, elements are sometimes illustrated on scales different from actual scales in order to make it easier to understand description related to the elements.

Embodiment 1

Figure 1:
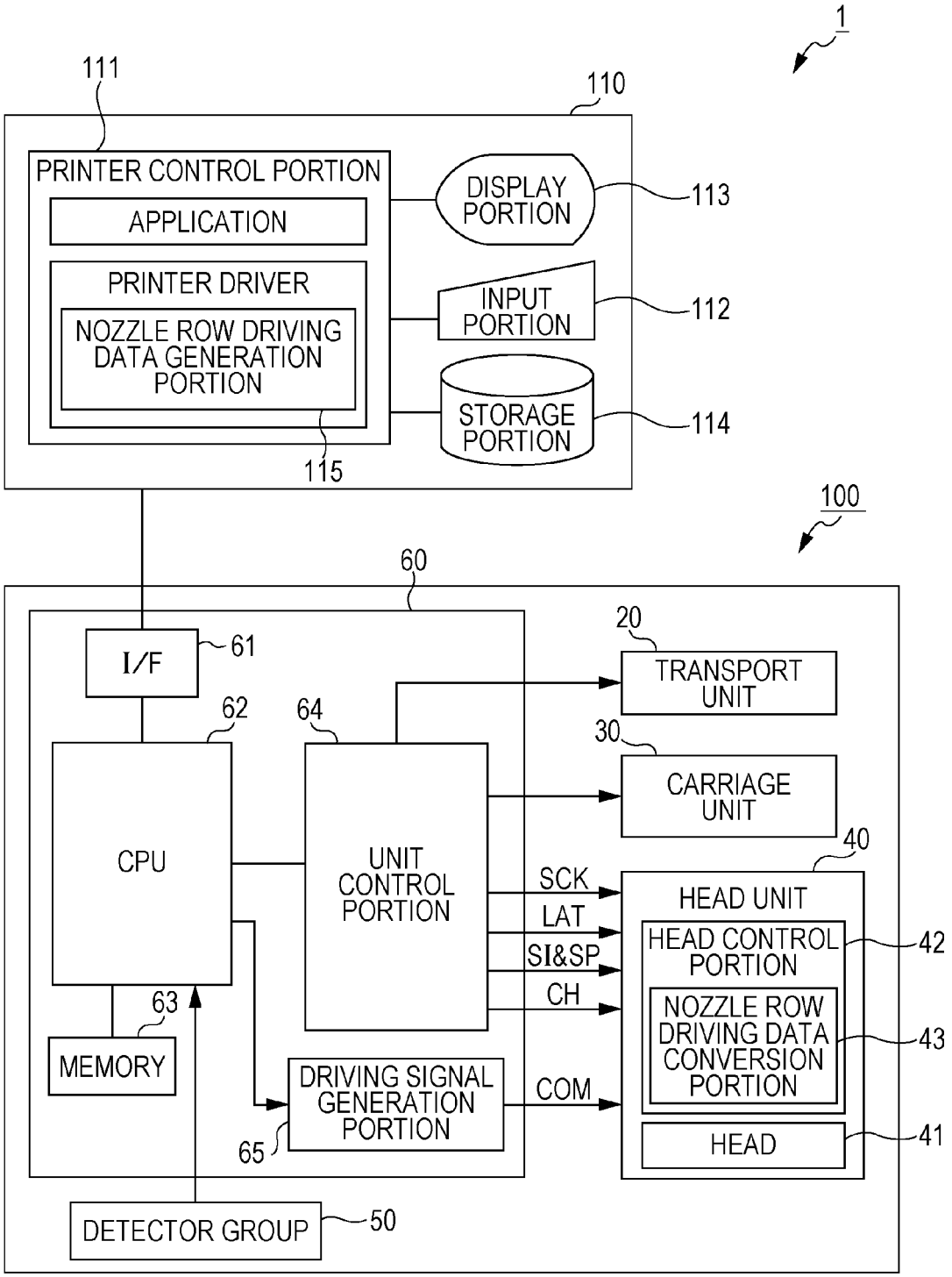
FIG. 1 is a block diagram illustrating an entire configuration of a liquid droplet ejecting apparatus according to an embodiment of the invention.

FIG. 1 is a block diagram illustrating an entire configuration of a liquid droplet ejecting apparatus 1 according to embodiment 1 of the invention.

The liquid droplet ejecting apparatus 1 is constituted by an ink jet printer 100 (hereinafter, referred to as a printer 100), a personal computer 110 (hereinafter, referred to as a PC 110), and the like.

The PC 110 includes a printer control portion 111, an input portion 112, a display portion 113, and a storage portion 114, and controls a print job in accordance with which the printer 100 performs printing.

The printer control portion 111 includes a CPU (a computing processing unit), storage units, such as a RAM, a ROM, and the like, (these components being omitted from illustration), and performs concentrated control of the whole of the liquid droplet ejecting apparatus 1.

The input portion 112 is an information input means as a human interface. Specifically, the input portion 112 includes, for example, a keyboard and ports each connected to an information input device.

The display portion 113 is an information display means (a display) as a human interface. The display portion 113 displays thereon pieces of information input from the input portion 112, an image to be printed by the printer 100, pieces of information based on a print job, and the like, under the control of the printer control portion 111.

The storage portion 114 is a rewritable storage medium, such as a hard disk drive (HDD) or a memory card, and stores therein software in accordance with which the PC 110 operates (i.e., programs that run on the printer control portion 111), an image to be printed, pieces of information based on a print job, and the like.

The software in accordance with which the PC 110 operates includes general image processing application software (hereinafter, referred to as an application program) and printer driver software (hereinafter, referred to as a printer driver).

Further, the printer control portion 111 includes, as a functional component thereof, a nozzle row driving data generation portion 115 inside the printer driver. This nozzle row driving data generation portion 115 will be described below.

Figure 2:
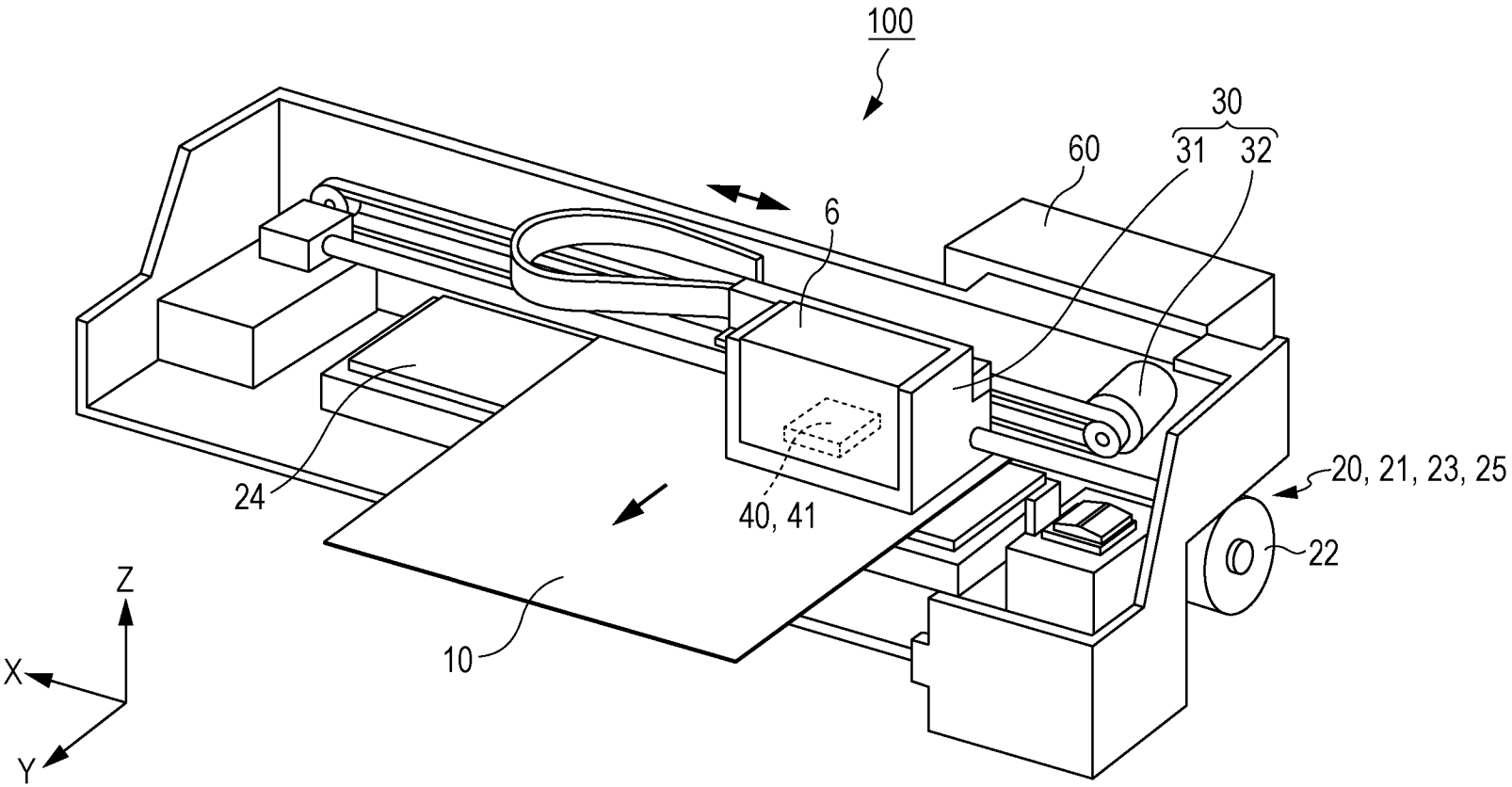
FIG. 2 is a perspective view illustrating an entire configuration of an ink jet printer.

FIG. 2 is a perspective view illustrating an internal configuration of the printer 100.

In addition, in axes X, Y, and Z that are appended in FIG. 2, the printer 100 is placed on a X-Y plane. Further, in the following description, a ±X direction (i.e., an X axis direction) corresponds to a scan direction, a Y direction corresponds to a transport direction, and a Z direction corresponds to a height direction.

A basic configuration of the printer 100 will be described below with reference to FIGS. 1 and 2.

Basic Configuration of Ink Jet Printer

The printer 100 includes a transport unit 20, a carriage unit 30, a head unit 40, a detector group 50, and a controller 60. Upon reception of a set of printing data from the PC 110, the printer 100 controls the individual units (the transport unit 20, the carriage unit 30, and the head unit 40) by using the controller 60. The controller 60 performs printing of an image on paper 10 as "a printing medium" by controlling the individual units on the basis of the set of printing data having been received from the PC 110. Driving states inside the printer 100 are monitored by the detector group 50, and monitored driving states (i.e., detection results) are output to the controller 60. The controller 60 controls the individual units on the basis of the detection results output from the detector group 50.

The set of printing data is, for example, a set of data for image formation resulting from conversion processing that is executed by the application program and the printer driver, which are included in the PC 110, and that is performed in order that, for example, general RGB based digital image information having been obtained by a digital camera or the like can be printed by the printer 100.

The transport unit 20 includes paper feeding rollers 21, a transport motor 22, transport rollers 23, a platen 24, paper ejecting rollers, and the like, and has the function of causing the paper 10 to move in a predetermined transport direction (in the Y axis direction shown in FIG. 2). The paper feeding rollers 21 are rollers for feeding the paper 10 having been inserted into a paper insertion inlet into the inside of the printer 100. The transport rollers 23 are rollers for transporting the paper 10 having been fed by the paper feeding rollers 21 up to a printing-enabled region, and are driven by the transport motor 22. The platen 24 supports the paper 10 at a position having a constant height during a period when printing is executed on the paper 10. The paper ejecting rollers 25 are rollers for ejecting the paper 10 to the outside of the printer 10, and are provided at a more downstream side position than the position of the printing-enabled region in the transport direction.

The carriage unit 30 has the function of moving (scanning) a liquid droplet ejecting head 41 described below in a predetermined movement direction (which is the X axis direction shown in FIG. 2 and will be referred to as a scan direction below). The carriage unit 30 includes a carriage 31, a carriage motor 32, and the like. The carriage 31 is capable of reciprocating in the scan direction, and is driven by the carriage motor 32. Further, the carriage 31 holds an ink cartridge 6 such that the ink cartridge 6 can be attached/detached to/from the cartridge 31.

The head unit 40 includes a head control unit 42 and the liquid droplet ejecting head 41 including a plurality of nozzle rows (i.e., (n+m) nozzle rows, each of n and m being a natural number), and has the function of ejecting inks as "liquid droplets" (hereinafter, also referred to as ink droplets) onto the paper 10. The liquid droplet ejecting head 41 is mounted in the carriage 31, and moves in the scan direction along with the movement of the carriage 31 in the scan direction. The liquid droplets ejecting head 41 intermittently ejects the ink droplets while moving in the scan direction, and thereby, dot rows (hereinafter, also referred to as raster lines), which are arranged in the scan direction and each of which is composed of a plurality of dots, are formed on the paper 10.

In this embodiment, as a method for ejecting ink droplets (i.e., an ink jet method), a piezo method is employed as a preferred example. This piezo method is a method for recording, in which each of piezoelectric elements (piezo elements) is controlled so as to, in accordance with a corresponding one of recording information signals, apply a pressure to an ink reserved in a corresponding one of pressure chambers, and thereby an ink droplet is ejected (discharged) through a corresponding one of liquid ejecting nozzles (hereinafter, referred to as nozzles), which communicates with the corresponding one of the pressure chambers.

It is to be noted that the method for ejecting ink droplets is not limited to this piezo method, and may be any other recording method in which inks are ejected in a liquid drop condition and thereby aggregates of dots are formed on a recording medium. The method for ejecting ink droplets may be, for example, a method in which ink droplets are forcibly ejected by causing a small pump to apply a pressure to inks and causing each of crystal oscillators or the like to mechanically oscillate a corresponding one of nozzles; or a method which is called a thermal jet method and in which ink droplets are ejected and thereby recording is performed by causing each of minute electrodes to heat and foam a corresponding one of inks in accordance with a corresponding one of recording information signals.

The controller 60 is a control portion for controlling the printer 100, and includes an interface portion (I/F) 61, a CPU 62, a memory 63, a unit control portion 64, a driving signal generation portion 65, and the like.

When performing printing, the controller 60 alternately repeats two kinds of operations: one being a liquid droplet ejection operation for ejecting inks, as liquid droplets, from the liquid droplet ejecting head 41 that is in a state of moving in the scan direction; the other one being a transport operation for moving the paper 10 in the transport direction, and thereby performs printing of an image composed of a plurality of dots.

The interface portion (I/F) 61 performs data transmission/reception between the PC 110 and the printer 100.

The CPU 62 is a computing processing unit for controlling the whole of the printer 1.

The memory 63 includes memory devices, such as RAM devices and EEPROM devices, and provides a storage area for storing programs executed by the CPU 62, a work area for use in processing executed by the CPU 62, and the like.

The CPU 62 controls the individual units (the transport unit 20, the carriage unit 30, and the head unit 40) via the unit control portion 64, in accordance with the programs stored in the memory 63.

The driving signal generation portion 65 generates a basic signal (a driving signal COM) on the basis of which each of piezo elements included in the liquid droplet ejecting head 41 is driven. The head unit 40 (the head control portion 42) selectively drives each of the piezo elements, which is associated with a corresponding one of the nozzles, on the basis of head control signals (described below) and the driving signal COM, these signals being transmitted from the controller 60. The details of the head unit 40 and the details of the driving signal COM will be described below.

The detector group 50 includes a linear encoder, a rotary encoder, a paper detection sensor, an optical sensor, and the like (these sensors being omitted from illustration). The linear encoder detects a position of the carriage 31 in the scan direction. The rotary encoder detects an amount of rotation of the transport rollers 23. The paper detection sensor detects a position of the front edge of the paper 10 that is in a state of being fed. The optical sensor is constituted by a light emitting portion and a light receiving portion that are mounted in the carriage 31. Further, through these light emitting portion and light receiving portion, the optical sensor detects presence/absence of the paper 10, positions of the both edge portions of the paper 10, a width-size of the paper 10, and the like. Moreover, the optical sensor detects the front edge of the paper 10 (which is a downstream side edge in the transport direction, and is also called an upper edge), and the rear edge of the paper 10 (which is an upstream side edge in the transport direction, and is also called a lower edge).

Process Flow of Printing

Next, a basic process flow of printing processing performed by the printer 100 will be described.

Upon reception of a printing command and printing data from the PC 110, the controller 60 analyzes the content of various commands included in the printing data, and performs the following processes by using the individual units (the transport unit 20, the carriage unit 30, and the head unit 40).

First, the controller 60 rotates the paper feeding rollers 21 to transport the paper 10 to be subjected to printing up to a region where the transport rollers 23 can be driven. Next, the controller 60 rotates the transport rollers 23 by driving the transport motor 22. When the transport rollers 23 are rotated by a predetermined rotation amount, the paper 10 is transported at a predetermined transport speed.

When the paper 10 is transported to a portion below the head unit 40, the controller 60 rotates the carriage motor 32 on the basis the printing command. The carriage 31 moves in the scan direction in conjunction with the rotation of the carriage motor 32. Further, the movement of the carriage 31 causes the liquid droplet ejecting head 41, which is mounted in the carriage 31, to move in the scan direction. Further, during a period when the liquid droplet ejecting head 41 moves in the scan direction, the controller 60 performs control so as to cause the piezo elements to be intermittently driven on the basis of the head control signals and the driving signal COM. Further, this process allows ink droplets to be intermittently ejected from the liquid droplet ejecting head 41 during a period when the liquid droplet ejecting head 41 moves in the scan direction. Further, these ink droplets having landed on the paper 10 form dot rows, in each of which a plurality of dots are arranged, in the scan direction.

In addition, an operation of forming dots by ejecting inks from the liquid droplet ejecting head 41 that is in a state of moving is called a pass. One pass means a dot formation operation that is performed through one movement operation in the scan direction. Further, an operation of ejecting inks from nozzle rows is called a shot. Through one shot, a plurality of dots that are arranged in the transport direction are formed by ink droplets that are ejected from nozzle rows (through a plurality of nozzles that are arranged in the transport direction).

Further, the controller 60 drives the transport motor 22 during a time interval between every two successive mutually opposite direction movement operations of the liquid droplet ejecting head 41 in the scan direction. The transport motor 22 rotates the transport rollers 23 in accordance with a drive amount having been instructed by the controller 60. When the transport rollers 23 are rotated by a predetermined rotation amount, the paper 10 is transported by a predetermined transport amount. Such a pass and a transport operation that are alternately repeated form an image composed of dot rows on the paper 10.

The controller 60 caused the paper ejecting rollers 25, which rotate in synchronization with the rotation of the transport rollers 23, to eject the paper 10 having been subjected to printing, and then terminates this printing processing.

Outline of Processing Performed by Printer Driver

Figure 3:
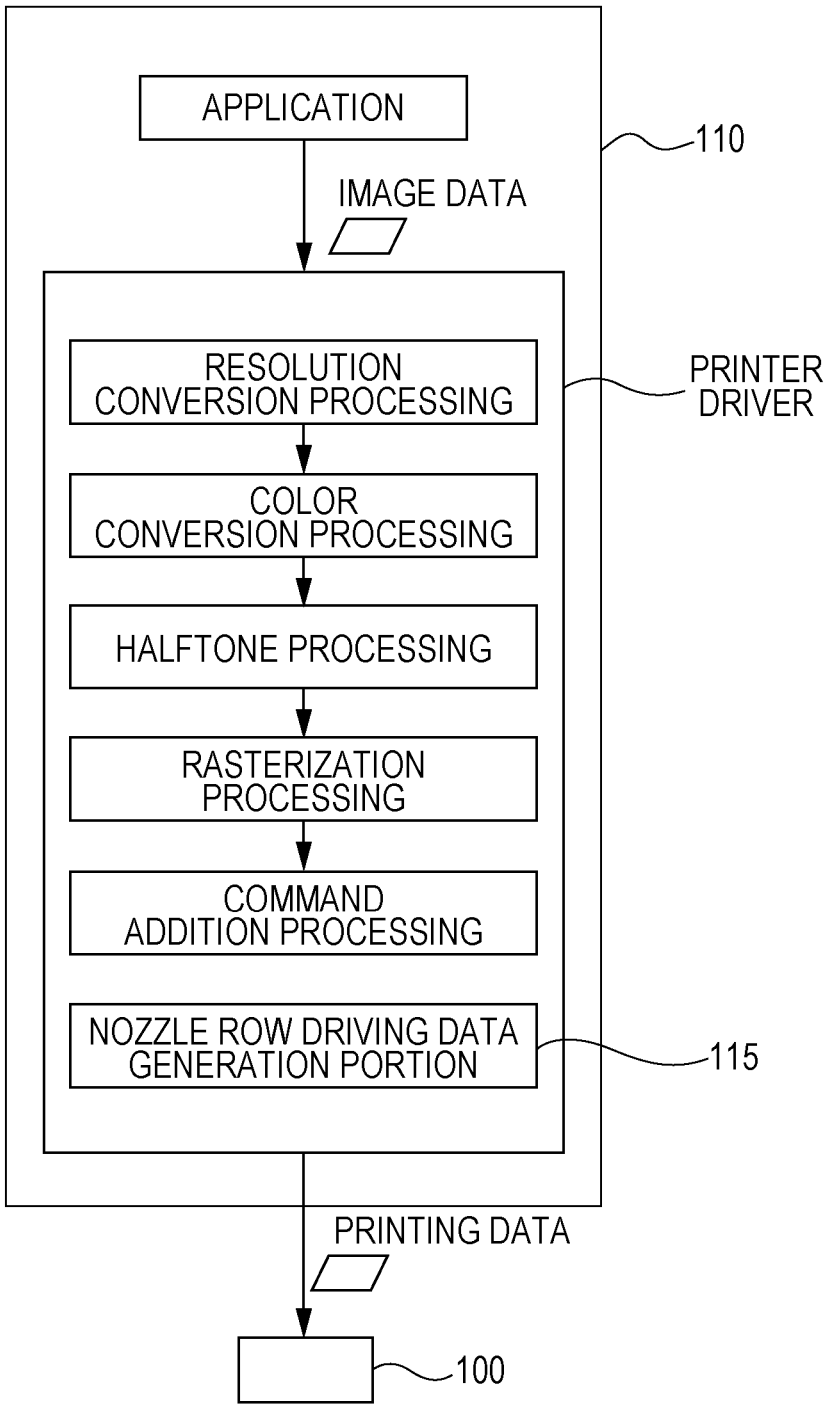
FIG. 3 is a diagram that describes processing performed by a printer driver.

As described above, the above printing processing is started upon reception of a set of printing data having been transmitted from the PC 110 that is communicably connected to the printer 100. The set of printing data is generated by the printer driver. Hereinafter, processing performed by the printer driver will be described with reference to FIG. 3. FIG. 3 is a diagram that describes the processing performed by the printer driver.

In addition, the printer driver has a function that features this embodiment and is implemented in the nozzle row driving data generation portion 115, but, here, a basic function that is based on existing technologies and is implemented in the printer driver will be described. The nozzle row driving data generation portion 115 will be described below.

Upon reception of a set of image data (text data, picture image data, or the like) from an application program, the printer driver convers the received set of image data into a set of printing data of a format that can be interpreted by the printer 100. When converting the set of image data having received from the application program into the set of printing data, the printer driver performs resolution conversion processing, color conversion processing, halftone processing, rasterization processing, command addition processing, and the like.

The resolution conversion processing is processing for converting the set of image data having been output from the application program into a set of image data having a resolution for use in printing on paper (i.e., a printing resolution). For example, when a specified printing resolution is 720×720 dpi, the resolution conversion processing convers the set of image data having been received from the application program, this received set of image data having a vector format, into a set of bit-map format image data having a resolution of 720×720 dpi. Each block of pixel data constituting the set of image data having been subjected to the resolution conversion processing corresponds to pixels that are arrayed in a matrix shape. Each of the pixels has, for example, one of 256 grayscale values in each of RGB color spaces. That is, each block of pixel data having been subjected to the resolution conversion processing indicates grayscale values of pixels that are associated with the relevant block of pixel data.

In the following description, pieces of pixel data corresponding to a row of pixels that are among the pixels arrayed in a matrix shape and that are arranged in a predetermined direction will be also referred to as "a block of raster data". In addition, the predetermined direction in which pixels corresponding to a block of raster data are arranged corresponds to a direction in which the liquid droplet ejecting head 41 moves when printing of an image is performed, that is, the scan direction of the liquid droplet ejecting head 41.

The color conversion processing is processing for converting RGB data into data in CMYK-color based spaces. The CMYK colors is thick cyan (C), thick magenta (M), yellow (Y), and thick black (K), and image data in the CMYK-color based spaces is data corresponding to the colors of inks for use in the printer 100. Thus, when the printer 100 uses ten kinds of CMYK-color based inks, the printer driver generates image data in ten dimensional CMYK-color based spaces on the basis of RGB data.

The color conversion processing is performed on the basis of a table (a color conversion lookup table LUT) in which grayscale values of RGB data are associated with grayscale values of CMYK-based color data. In addition, each block of pixel data having been subjected to the color conversion processing corresponds to pieces of CMYK-based color data each indicating one of 256 grayscale values in a corresponding one of CMYK-based color spaces.

The halftone processing is processing for converting pieces of data each indicating one of high grayscale values (256 grayscale values) into pieces of image data each indicating one of grayscale values whose total number is small enough for the printer 100 to deal with. Through this halftone processing, each piece of data indicating one of 256 grayscale values is converted into a piece of data composed of one bit capable of representing two dot grayscale values, or two bits capable of representing four dot grayscale values. Each block of pixel data having been subjected to the halftone processing corresponds to pieces of data each composed of one bit or two bits, and this block of pixel data becomes a block of data consisting of pieces of data each specifying a dot formation condition with respect to a corresponding one of dots. Here, the dot formation condition specifies "presence/absence" or one of "absence" and sizes, with respect to the relevant dot.

For example, in the case of two bits capable of representing four dot grayscale values, the dot formation condition specifies four kinds of dot formations each associated with a corresponding one of the four dot grayscale values: no dot formation associated with a dot grayscale value [00]; a small-size dot formation associated with a dot grayscale value [01]; a middle-size dot formation corresponding to a dot grayscale value [10]; and a large-size dot formation corresponding to a dot grayscale value [11]. Subsequently, a dot generation ratio is determined for each dot size, and then, blocks of pixel data are generated such that the generated blocks of pixel causes the printer 100 to form the dots at dispersed positions, by utilizing a dither method, a gamma correction, or an error diffusion method.

The rasterization processing is processing for rearranging pieces of pixel data that are arranged in a matrix shape, in accordance with dot formation order for use in execution of printing. For example, in the case where, when printing is performed, dot formation processing is performed by being divided into several dot formation processes, blocks of pixel data each associated with a corresponding one of the divided dot formation processes are extracted and each of the extracted blocks of pixel data is rearranged in accordance with order of a corresponding one of the dot formation processes. In addition, when printing is performed in accordance with a different printing method, the execution order of the dot formation processes also becomes different, and thus, the rasterization processing is performed in accordance with each of printing methods.

The command addition processing is processing for adding a block of command data in accordance with a printing method to a set of printing data having been subjected to the rasterization processing. The block of command data includes, for example, a piece of transport data indicating a transport speed of a printing medium.

A set of printing data having been generated through the above series of processing is transmitted to the printer 100 by the printer driver.

Printing Head (Nozzle Rows)

Figure 4:
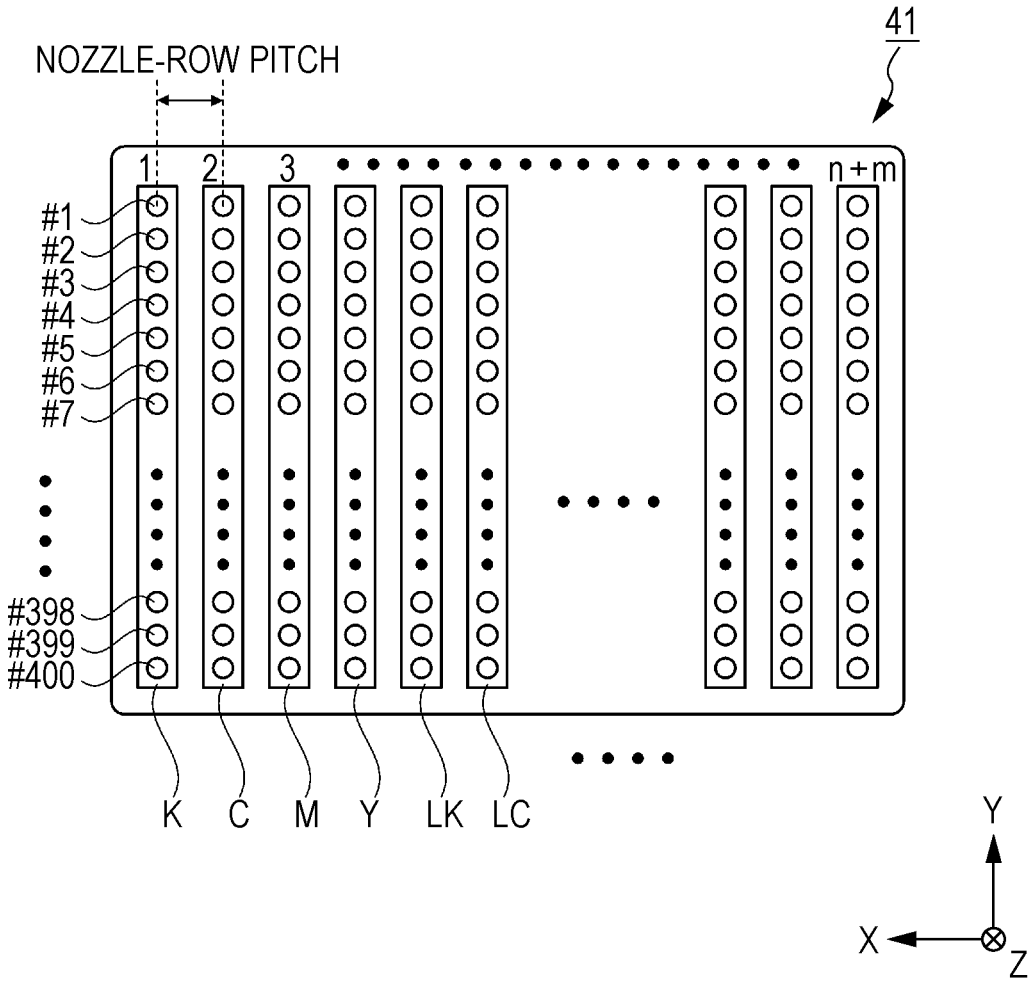
FIG. 4 is a diagram that describes an array of nozzles.

FIG. 4 is a diagram that describes an array of nozzles disposed on the bottom face of the liquid droplet ejecting head 41. As shown in FIG. 4, a plurality of nozzle rows ((n+m) nozzle rows) are arranged and formed in the scan direction (in the X axis direction) on the bottom face of the liquid droplet ejecting head 41. The plurality of nozzle rows ((n+m) nozzle rows) include a black ink nozzle row K, a cyan ink nozzle row C, a magenta ink nozzle row M, a yellow ink nozzle row Y, a gray ink nozzle row LK, a light cyan ink nozzle row LC, and the like.

A plurality of nozzles that are formed in each of the nozzle rows align at intervals of a constant distance (at intervals of a constant nozzle pitch) in the transport direction (in the Y axis direction). In FIG. 4, the value of an identification number (one of #1 to #400) given to each of the nozzles included in each nozzle row decreases as the position of the relevant nozzle moves toward the downstream side. That is, a nozzle #1 is located at a more downstream side position than the position of a nozzle #400 in the transport direction. For each of the nozzles, a piezo element, which operates as a driving element that performs driving so as to cause ink droplets to be ejected through the relevant nozzle, is provided.

Figure 5:
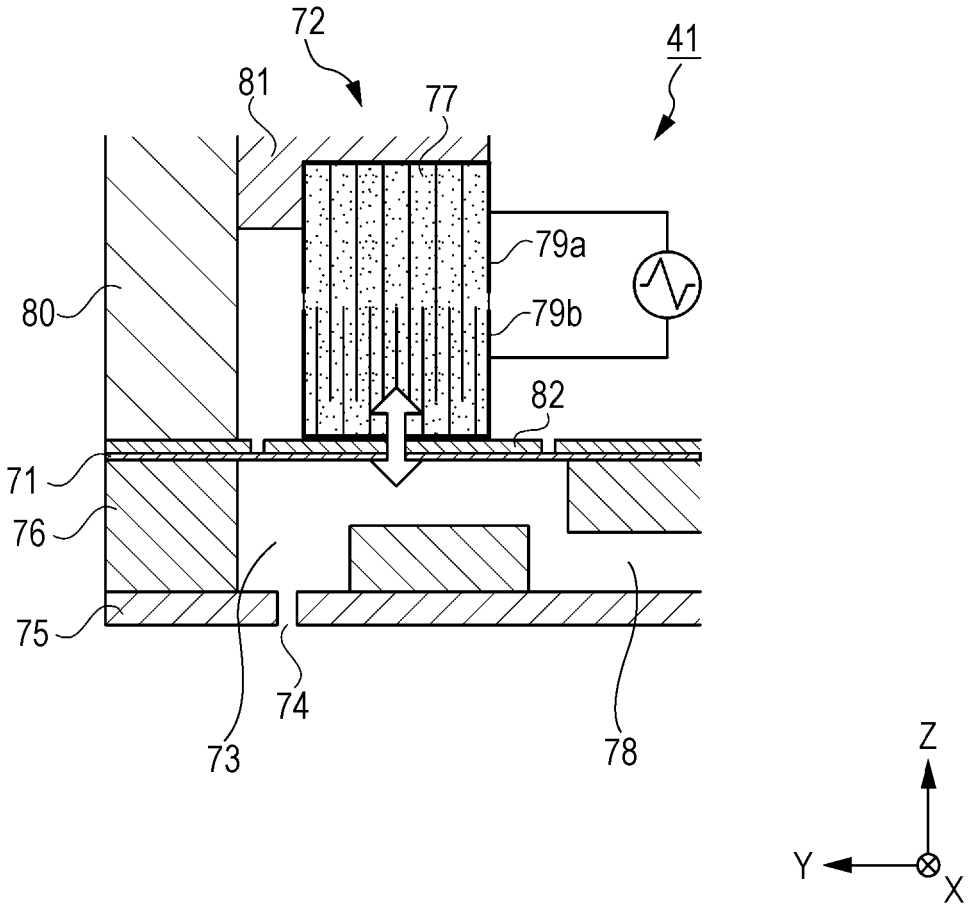
FIG. 5 is a cross-sectional view of a surrounding region of a nozzle.

FIG. 5 is a cross-sectional view of a surrounding region of a nozzle of the liquid droplet ejecting head 41. FIG. 5 schematically illustrates a structure of the periphery of a nozzle 74.

The liquid droplet ejecting head 41 includes at least a vibration plate 71; a piezoelectric actuator 72 for displacing the vibration plate 71; a cavity (a pressure chamber) 73 in which an ink is filled and which has a pressure whose magnitude is increased/decreased by the displacement of the vibration plate 71; a nozzle 74 which communicates with the cavity 73 and through which the ink is ejected as liquid droplets in conjunction with the increase/decrease of the pressure of the inside of the cavity 73.

The nozzle 74 is formed in the nozzle plate 75, and the cavity 73 and a reservoir 78 that communicates with the cavity 73 are formed in a cavity substrate 76 that is positioned so as to be sandwiched by the nozzle plate 75 and the vibration plate 71. The reservoir 78 communicates with the ink cartridge 6 (refer to FIG. 2) via an ink flow path (omitted from illustration).

The piezoelectric actuator 72 includes comb-teeth-shaped electrodes 79*a* and 79*b* that are disposed so as to face each other, and piezoelectric elements (piezo elements) 77 that are disposed such that the piezoelectric elements 77 and each of comb tooth of the electrodes 79*a* and 79*b* are alternately stacked.

As shown in FIG. 5, one of both edge portions of the piezoelectric actuator 72 is fixed to a fixing plate 81 that is fixed to a housing 80 of the liquid droplet ejecting head 41, and the other one of the both edge portions thereof is joined to the vibration plate 71 via a joining plate 82.

In the piezoelectric actuator 72 configured in such a way described above, ink droplets are ejected through the nozzle 74 by the variation of the pressure of the internal of the cavity 73 in conjunction with upward and downward vibrations of the vibration plate 71, which are caused by supplying a driving signal between the electrodes 79*a* and 79*b*. In addition, the upward and downward vibrations of the vibration plate 71 are denoted by a bidirectional arrow in FIG. 5.

Head Unit in Existing Technology

Figure 6:
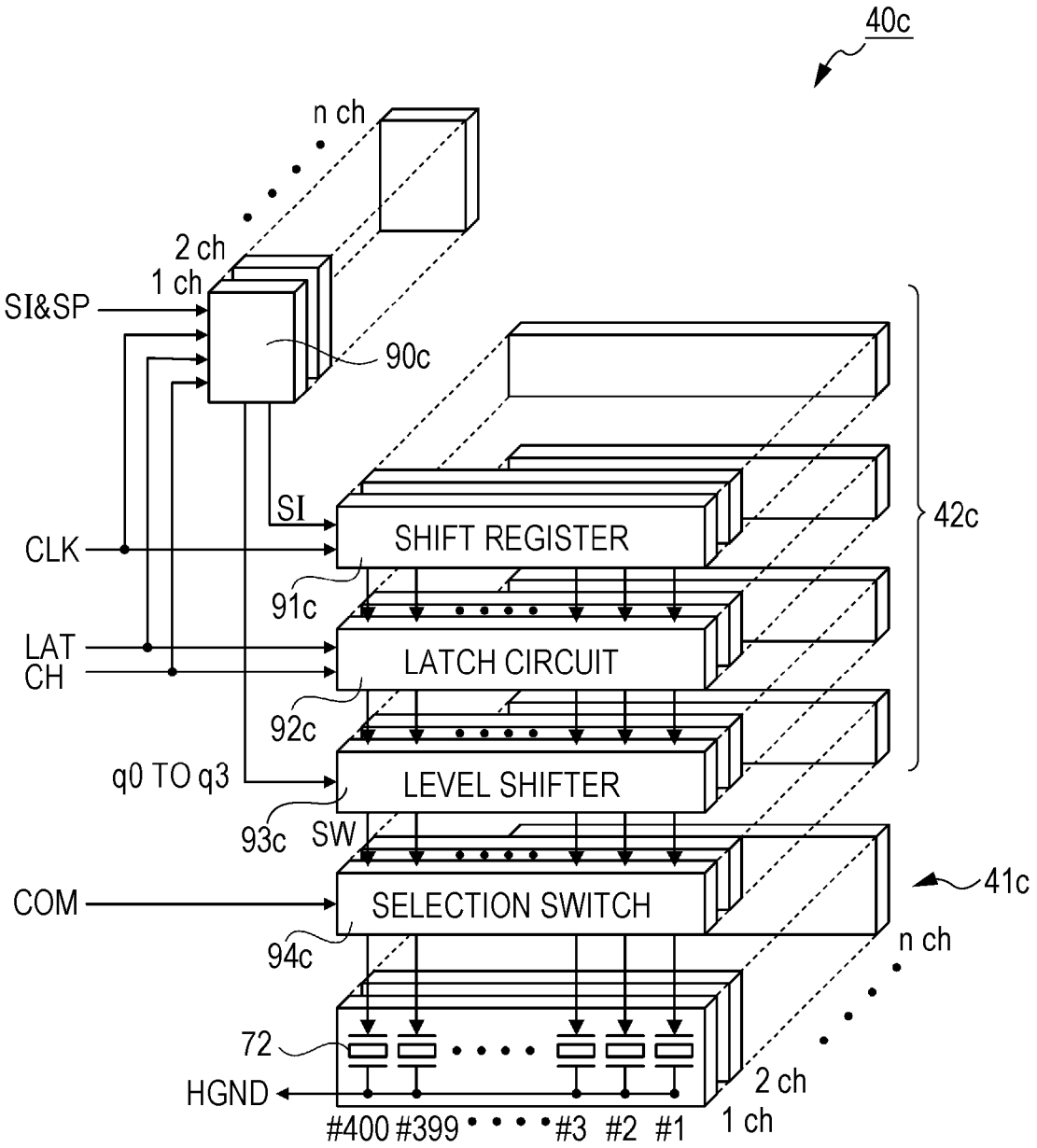
FIG. 6 is a block diagram illustrating a configuration of a head unit in an existing technology.

FIG. 6 is a block diagram illustrating a configuration of a head unit 40*c* in an existing technology.

The head unit 40*c* does not include the nozzle row driving data conversion portion 43 shown in FIG. 1. This nozzle row driving data conversion portion 43 is a portion that features this embodiment, and the details thereof will be described below. Here, basic functions of a head unit will be described by using the existing head unit 40*c* that does not include the nozzle row driving data conversion portion 43.

The head unit 40*c* is constituted by a head control portion 42*c*, a liquid droplet ejecting head 41*c*, and the like. In addition, the liquid droplet ejecting head 41*c* includes n nozzle rows.

The head control portion 42*c* has, for each of the n nozzle rows, the function of generating and supplying driving signals for use in selective driving of each of piezo elements (piezoelectric actuators 72) that is associated with a corresponding one of nozzles, on the basis of head control signals and a driving signal COM. That is, the head control portion 42*c* has, for each of the n nozzle rows, the function of selectively supplying the driving signal COM to each of the piezoelectric actuators 72 on the basis of a set of printing data.

The head control portion 42*c* includes, for each of the n nozzle rows, a control logic 90*c*, a shift register 91*c*, a latch circuit 92*c*, a level shifter 93*c*, a selection switch 94*c*, and the like.

The head control signals are signals including a clock signal CLK, a latch signal LAT, a change signal CH, a setting signal SI & SP including pieces of pixel data SI and pieces of setting data SP, and the like.

The control logic 90*c* generates the pieces of pixel data SI and waveform selection signals q0 to g3 (described below) from the head control signals having been received from the controller 60, and transmits the pieces of pixel data SI and the waveform selection signals q0 to q3 to the shift register 91*c* and the level shifter 93*c*, respectively.

The shift register 91*c* is a portion to which the pieces of pixel data SI are input as a serial signal, and in synchronization with input timing of each of pulses constituting the clock signal CLK, each of pieces of pixel data constituting the pixel data SI is sequentially input to a first stage of storage areas of the relevant shift register 91*c*, and then is sequentially shifted to a further subsequent stage of the storage areas thereof.

Thereafter, in a state in which all pieces of pixel data SI each associated with a corresponding one of the nozzles included in the relevant nozzle row have been stored in the shift register 91*c*, the latch circuit 92*c* latches the all pieces of pixel data output from the shift register 91*c* at input timing of the latch signal LAT, and temporarily stores the pieces of pixel data as pieces of parallel pixel data.

The level shifter 93*c* generates signals (switching signals SW) each for turning on/off of a corresponding one of selection switches included in the selection switch 94*c* on the basis of the pieces of pixel data SI (the pieces of parallel pixel data stored in the latch circuit 92*c*) and the waveform selection signals q0 to q3. Further, the level shifter 93*c* converts the voltage levels of the generated switching signals SW into voltage levels that are high enough to drive the selection switch 94*c*. This conversion of the voltage levels is made because the operating voltage range of the selection switch 94*c* is set to a high voltage level in order to suit the voltage level of the driving signal COM, which is higher than those of the signals output from the latch circuit 92*c*.

The selection switch 94*c* selectively connects and supplies the driving signal COM to each of the piezoelectric actuators 72 in accordance with a corresponding one of the switching signals SW output from the level shifter 93*c*.

The pieces of pixel data stored in the latch circuit 92*c* are repeatedly updated in synchronization with timing when the ejection of ink droplets is performed in a state in which, subsequent to the storage of the pieces of pixel data SI stored in the shift register 91*c* into the latch circuit 92*c*, the input of next pieces of pixel data SI into the shift register 91*c* is completed.

In addition, in FIG. 6, a reference sign "HGND" denotes a ground terminal of the piezoelectric actuators 72. Further, according to the selection switch 94*c*, after disconnection of each of the piezoelectric actuators 72 from the driving signal COM, a voltage input to the relevant piezoelectric actuator 72 is kept to a voltage as of immediately before the disconnection.

Figure 7:
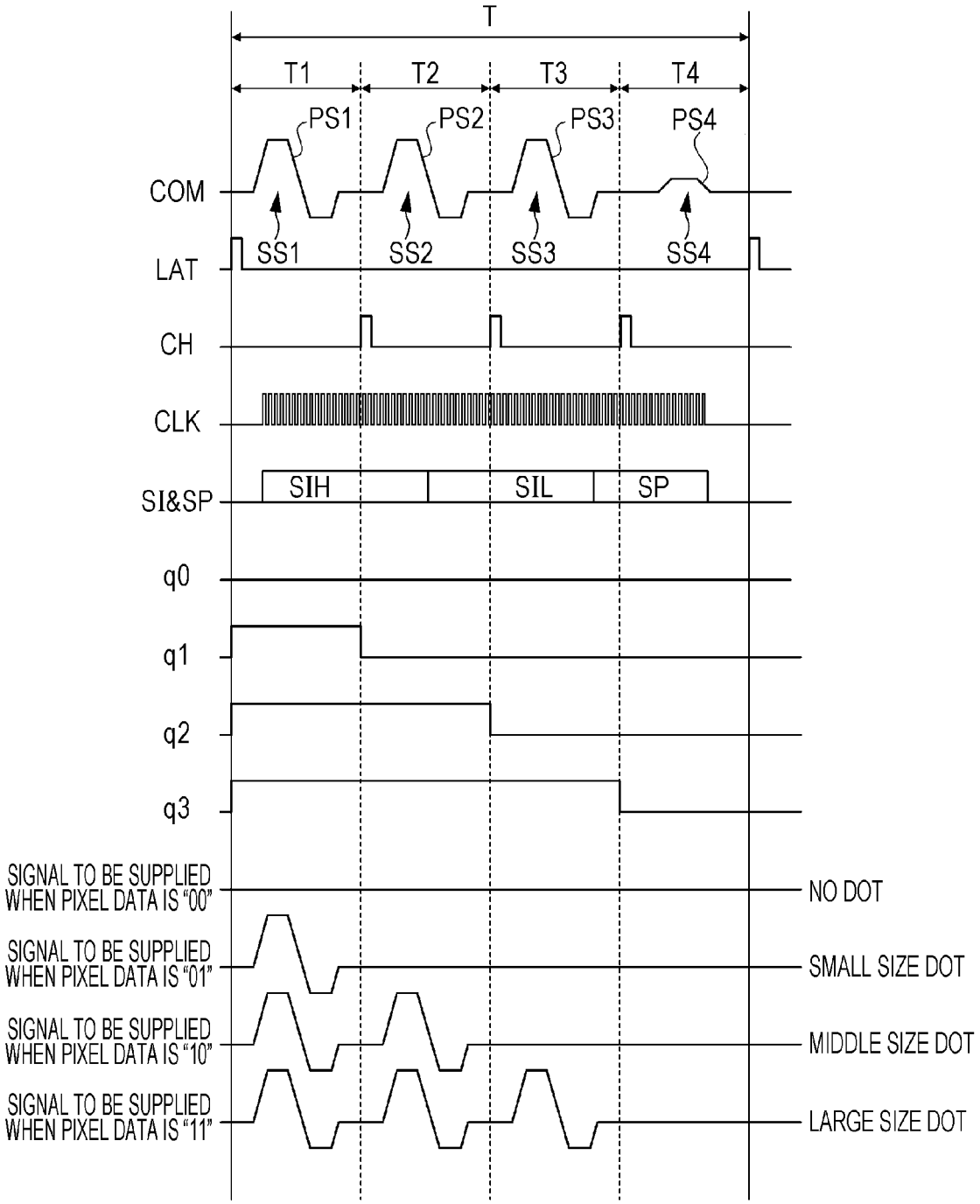
FIG. 7 is a diagram that describes head control signals and a driving signal COM.

FIG. 7 is a diagram that describes the head control signals and the driving signal COM.

Figure 8A:
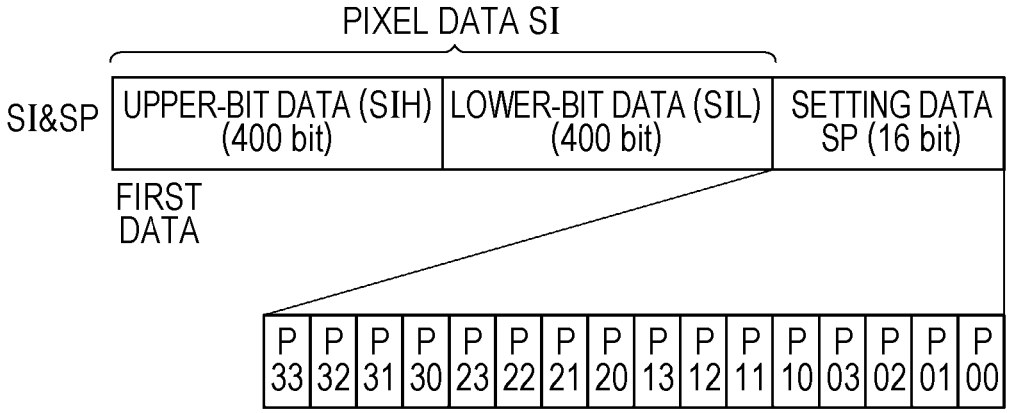
FIG. 8A is a diagram that describes a setting signal SI & SP.
Figure 8B:
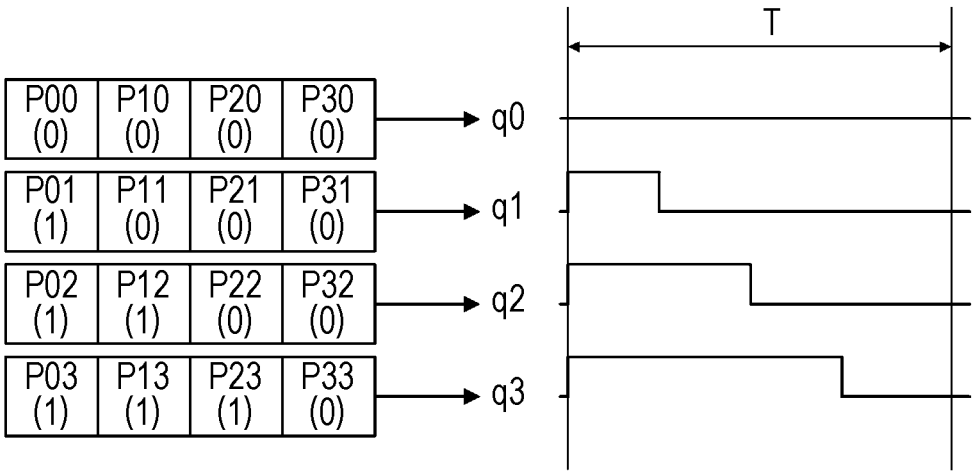
FIG. 8B is a diagram that describes waveform selection signals.

Further, FIG. 8A is a diagram that describes the setting signal SI & SP, and FIG. 8B is a diagram that describes the waveform selection signals qo to q3.

In FIGS. 7 and 8, a period T, which is a repeated cycle, corresponds to a period during which the nozzles move in the scan direction by one pixel pitch. Hereinafter, the period T that is a repeated cycle will be referred to as just a cycle T or a period T. For example, when the printing resolution is 720 dpi, the period T corresponds to a period during which the nozzles move relative to the paper 10 by 1/720 inches.

Each of the piezo elements is supplied with a corresponding supply signal, which is generated from the driving signal COM including driving pulses PS1 to PS4 each existing within a corresponding one of intervals T1 to T4 constituting the period T, on the basis of a corresponding one of the pieces of pixel data included in the set of printing data, and which includes none, or one or more of the driving pulses PS1 to PS 4. Further, this mechanism makes it possible to eject an ink droplet having one of different sizes onto an area associated with a corresponding pixel, and thereby represent a plurality of grayscale levels.

In the cycle T, the driving signal COM includes a first interval signal SS1 generated during the interval T1; a second interval signal SS2 generated during the interval T2; a third interval signal SS3 generated during the interval T3; and a fourth interval signal SS4 generated during the interval T4. The first interval signal SS1 includes the driving pulse PS1. Further, the second interval signal SS2, the third interval signal SS3, and the fourth interval signal SS4 includes the driving pulse 2, the driving pulse 3, and the driving pulse 4, respectively. In addition, the driving pulses PS1, PS2, and PS3 are pulses that are supplied to a corresponding piezo element when a large-size dot is formed, and that have the same waveform. Further, the driving pulses PS1 and PS2 are pulses that are supplied to a corresponding piezo element when a middle-size dot is formed. Further, the driving pulse PS1 is a pulse that is supplied to a corresponding piezo element when a small-size dot is formed. Further, the driving pulse PS 4 is a pulse that is supplied to a corresponding piezo element when slightly vibrating the relevant piezo element.

When the setting signal SI & SP has been input to the head control portion 42*c* during the cycle T (during a period between every two successive LAT pulses) in synchronization with each pulse constituting the clock signal CLK, pieces of upper bit data (SIH) and pieces of lower bit data (SIL), these two kinds of bit data being included in the setting signal SI & SP, are set in an upper area and a lower area, respectively, which are included in the shift register 91*c*. That is, an upper bit constituting two bits of a piece of pixel data corresponding to each nozzle is set in the upper area of the shift register 91*c* and a lower bit constituting the two bits of the piece of image data corresponding to each nozzle is set in the lower area of the shift register 91*c*. Further, the pieces of setting data SP included in the setting signal SI & SP are set in a shift register group (not illustrated) of the control logic 90*c*.

In response to each of pulses constituting the latch signal LAT, pieces of upper bit data are latched into the upper area of the latch circuit 92*c* and pieces of lower bit data are latched into the lower area of the latch circuit 92*c*. That is, an upper bit of two bits of pixel data corresponding to each nozzle (each piezo element) is latched into the upper area of the latch circuit 92*c*, and a lower bit of the two bits of pixel data corresponding to each nozzle (each piezo element) is latched into the lower area of the latch circuit 92*c*.

The setting data SP is composed of sixteen bits of data (refer to FIG. 8A). The control logic 90*c* generates the waveform selection signal q0 on the basis of and the change signal CH and predetermined four bits of data (i.e., data P00, data P10, data P20, and data P30) of the sixteen bits of data constituting the setting data SP. Similarly, the control logic 90*c* generates each of the waveform selection signals q1 to q3 on the basis of the change signal CH and corresponding predetermined four bits of data of the sixteen bits of data constituting the setting data SP.

For example, in an example shown in FIG. 8B, among the sixteen bits of data constituting the setting data SP, data P01, data P02, data P03, data P12, data P13, and data P23 are "1", and the other bits of data constituting the setting data SP are "0". Thus, four bits of data (the data P00, the data P10, the data P20, and the data P30) corresponding to the waveform selection signal q0 become "0000" and, as a result, the waveform selection signal q0 becomes L level during the cycle T. Similarly, four bits of data (the data P01, data P11, data P21, and data P31) corresponding to the waveform selection signal q1 become "1000" and, as a result, the waveform selection signal q1 becomes H level during the first interval T1 and L level during intervals from the second interval T2 to the fourth interval T4. Similarly, each of the waveform selection signals q2 and q3 becomes a corresponding signal shown in FIG. 8B.

The level shifter 93*c* selects one of the waveform selection signals q0 to q3 in accordance with two bits of pixel data, one being a bit of pixel data latched in the upper area of the latch circuit 92*c*, the other one being a bit of pixel data latched in the lower area of the latching circuit 92*c*. Specifically, the waveform selection signal q0 is selected when the relevant piece of pixel data is "00" (that is, when an upper bit is "0" and a lower bit is "0"); the waveform selection signal q1 is selected when the relevant piece of pixel data is "01"; the waveform selection signal q2 is selected when the relevant piece of pixel data is "10"; and the waveform selection signal q3 is selected when the relevant piece of pixel data is "11". The selected waveform selection signal is output from the level shifter 93*c* as one of the switching signals SW.

Each of selection switches constituting the selection switch 94*c* is supplied with the driving signal COM and a corresponding one of the switching signals SW. When the supplied switching signal SW is H level, the relevant selection switch becomes ON state and the driving signal COM is supplied to a corresponding actuator 72 (piezo element). When the supplied switching signal SW is L level, the relevant selection switch becomes OFF state and the driving signal COM is not supplied to a corresponding actuator 72.

That is, when the relevant piece of pixel data is "00", the waveform selection signal q0 is output as a corresponding switching signal SW. This waveform selection signal q0 causes a corresponding selection switch of the selection switch 94*c* to become OFF state during the repeated cycle T. As a result, any one of the pulses of the driving signal COM is not supplied to a corresponding piezo element. In this case, any ink droplet is not ejected through a corresponding nozzle.

Further, when the relevant piece of pixel data is "01", a corresponding selection switch of the selection switch 94*c* is turned on/off by the waveform selection signal q1. As a result, the first interval signal SS1 of the driving signal COM is supplied to a corresponding piezo element, which is driven by the driving pulse PS1. Further, this drive of the relevant piezo element by the driving pulse PS1 causes a small-size dot to be formed on the paper 10.

When the relevant piece of pixel data is "10", a corresponding selection switch of the selection switch 94*c* is turned on/off by the waveform selection signal q2. As a result, the first interval signal SS1 and the second interval signal SS2 of the driving signal COM are supplied to a corresponding piezo element, which is driven by the driving pulses PS1 and PS2. Further, this drive of the relevant piezo element by the driving pulses PS1 and PS2 causes a middle-size dot to be formed on the paper 10.

When the relevant piece of pixel data is "11", a corresponding selection switch of the selection switch 94*c* is turned on/off by the waveform selection signal q3. As a result, the first interval signal SS1, the second interval signal SS2, and the third interval signal SS3 of the driving signal COM are supplied to a corresponding piezo element, which is driven by the driving pulses PS1, PS2, and PS3. Further, this drive of the relevant piezo element by the driving pulses PS1, PS2, and PS3 causes a large-size dot to be formed on the paper 10.

Head Unit According to Embodiment 1

As shown in FIG. 1, the head unit 40 according to embodiment 1 includes the nozzle row driving data conversion portion 43 that features this embodiment. Further, through a replacement of the head unit 40*c* that includes n nozzle rows and constitutes, for example, a printer 100*c* (omitted from illustration) by the head unit 40 that includes (n+m) nozzle rows and that is provided with the nozzle row driving data conversion portion 43, and the use of a printer driver that supports the head unit 40, which is a substitute for the head unit 40*c*, it becomes possible to configure the printer 100 that includes the (n+m) nozzle rows.

Hereinafter, specific description will be made.

Figure 9A:
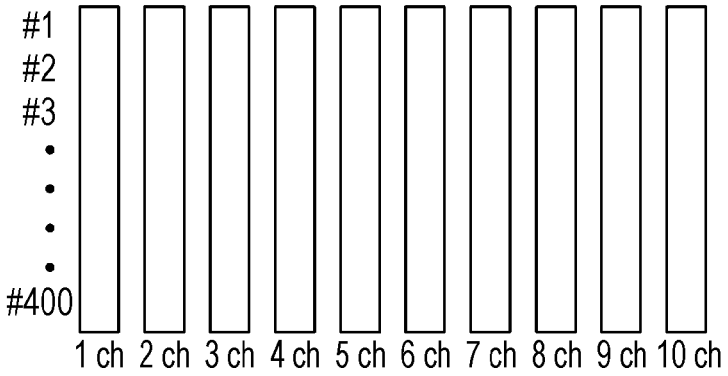
FIGS. 9A, 9B, and 9C are conceptual diagrams illustrating states in which n sets of nozzle row driving data for the (n+m) rows of nozzles are converted into (n+m) sets of nozzle row driving data for the (n+m) rows of nozzles.
Figure 9B:
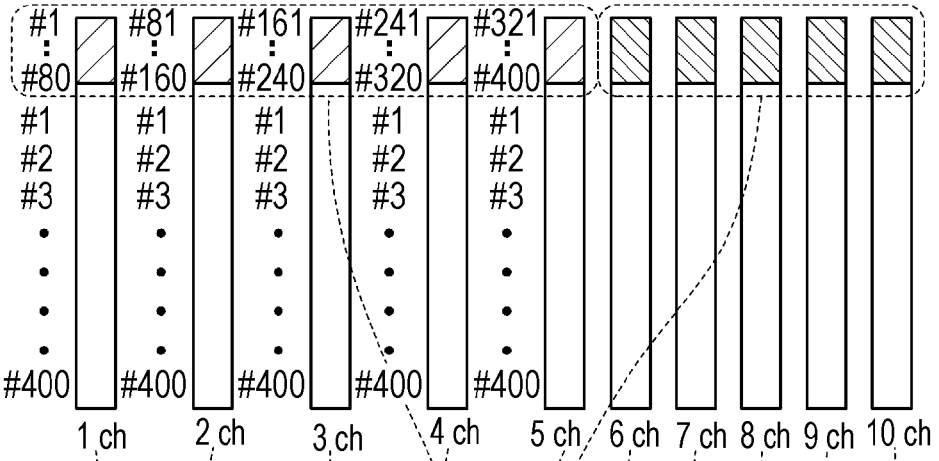
Figure 9C:
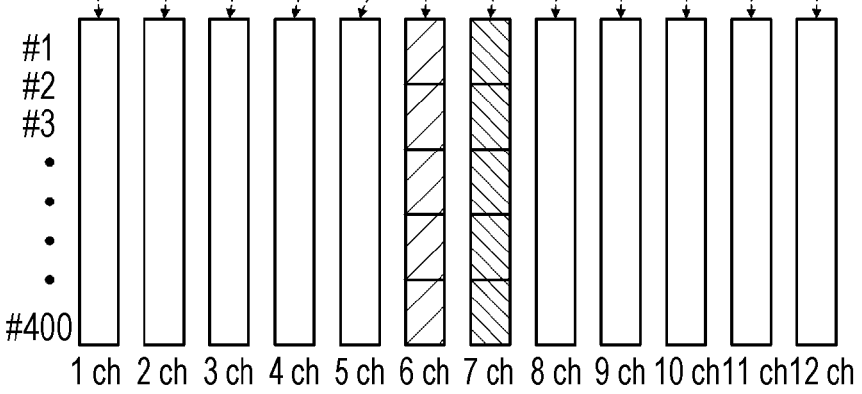

FIGS. 9A to 9C are conceptual diagrams illustrating states in which n sets of nozzle row driving data for the (n+m) rows of nozzles are converted into (n+m) sets of nozzle row driving data for the (n+m) rows of nozzles. FIGS. 9A to 9C illustrate a case where n=10 and m=2.

FIG. 9*a* illustrates a state in which, in the printer 100*c* provided with the head unit 40*c* including, for example, ten (n=10) nozzle rows, ten sets of pixel data (nozzle row driving data) that are associated with one shot are arranged. In FIG. 9*a*, pieces of nozzle row driving data #1 to #400 constituting each set indicate pieces of pixel data that have been arranged as the result of the rasterization processing, and that are associated with one shot through which ink droplets are ejected through nozzles #1 to #400 constituting a nozzle row corresponding to the each set. More specifically, each set of nozzle row driving data corresponds to a set of data related to the setting signal SI & SP associated with one shot through which droplets are ejected through nozzles constituting a nozzle row corresponding to the each set of nozzle row driving data. These sets of data related to the setting signal SI & SP are concurrently transmitted, for each nozzle row, to the head unit 40*c* (the head control portion 42*c*) via a corresponding one of mutually different channels 1*ch* to 10*ch* (refer to FIG. 6).

FIG. 9B illustrates a state in which, in the head unit 40 including twelve (n+m=10+2) nozzle rows, twelve sets of pixel data (nozzle row driving data) associated with one shot are rearranged into ten sets of nozzle row driving data in order to transmit the twelve sets of nozzle row driving data by using the ten channels (1*ch* to 10*ch*). Two sets of nozzle row driving data other than data for ten channels are each divided into five blocks. Each of the five blocks of one set of the two is added to 1*ch* to 5*ch* and those of the other set are similarly added to 6*ch* to 10*ch*. That is, ten sets of nozzle row driving data that are associated with twelve rows of nozzle row driving data are formed. This conversion of the twelve rows of nozzle row driving data into the ten sets of nozzle row driving data makes it possible to transmit the twelve rows of nozzle row driving data to the head unit 40 (the head control portion 42) via the ten channels (1*ch* to 10*ch*).

FIG. 9C illustrates a state in which the ten sets of nozzle row driving data that is associated with the twelve rows of nozzle row driving data and that have been transmitted via the ten channels (1*ch* to 10*ch*) are converted (reproduced) into twelve sets of nozzle row driving data each of which is associated with a corresponding one of the twelve rows of nozzle row driving data. As shown by using dashed lines interconnecting FIG. 9B and FIG. 9C, the five blocks of nozzle row driving data each having been divided and added to a corresponding one of the sets of nozzle row driving data 1*ch* to 5*ch* are reproduced as a set of nozzle row driving data 6*ch*, and the five blocks of nozzle row driving data each having been divided and added to a corresponding one of the sets of nozzle row driving data 6*ch* to 10*ch* are reproduced as a set of nozzle row driving data 7*ch*. With respect to the other ones of the twelve sets of nozzle row driving data shown in FIG. 9C, sets of nozzle row driving data resulting from removing the five additional blocks of nozzle row driving data from the sets of nozzle row driving data 1*ch* to 5*ch* shown in FIG. 9B are rearranged as sets of nozzle row driving data 1*ch* to 5*ch* shown in FIG. 9C. Further, sets of nozzle row driving data resulting from removing the five additional blocks of nozzle row driving data from the sets of nozzle row driving data 6*ch* to 10*ch* shown in FIG. 9B are rearranged as sets of nozzle row driving data 8*ch* to 12*ch* shown in FIG. 9C.

According to this method, twelve sets of nozzle row driving data each for driving a corresponding one of twelve nozzle rows are converted into ten sets of nozzle row driving data in advance; the resultant ten sets of nozzle row driving data are transmitted; and the twelve sets of nozzle row driving data are reproduced on the basis of the received ten sets of nozzle row driving data. Accordingly, this method makes it possible to, even when the controller (the unit control portion 64) includes only channels whose total number is n (=10) that is less than the total number of nozzle rows: (n+m) (=12), execute printing by ejecting ink droplets through the (n+m) (=12) nozzle rows.

Nozzle Row Driving Data Generation Portion

The function of converting the twelve sets of nozzle row driving data for driving the twelve nozzle rows into the ten sets of nozzle row driving data in advance is performed in a "nozzle row driving data generation portion" as one of functions implemented in the printer driver. As shown in FIGS. 1 and 3, the printer driver includes the nozzle row driving data generation portion 115 in the inside thereof.

The nozzle row driving data generation portion 115 performs processing for composing the foregoing sets of data on printing data having been subjected to the command addition processing. That is, under a situation where the number of nozzle rows included in the head unit 40 is larger than the number of the channels (=n) via which the sets of nozzle row driving data (the sets of setting signals SI & SP) are transmitted from the controller 60 to the head unit 40, and the difference number is m, when printing using (n+m) nozzle rows is desired to be performed, first, the printer driver generates printing data on the premise of the use of the (n+m) nozzle rows. As a result, the generated printing data is composed so as to include (n+m) sets of nozzle row driving data. Subsequently, in order to transmit this printing data from the controller 60 (the unit control portion 64) via the n channels, the printer driver (the nozzle row driving data generation portion 115) converts the (n+m) sets of nozzle row driving data into n sets of nozzle row driving data. That is, the nozzle row driving data generation portion 115 generates n sets of nozzle row driving data that are associated with the (n+m) rows of nozzle row driving data each for driving a corresponding one of the (n+m) rows. Subsequently, the (n+m) rows of nozzle row driving data that are divided into the n sets of nozzle row driving data are transmitted to the head unit 40 via the n channels.

In addition, when dividing the m sets of nozzle row driving data that are excesses over a channel number n into the n blocks of nozzle row driving data and adding each of the n blocks of nozzle row driving data to an upper portion of a corresponding one of the n sets of nozzle row driving data, the driving data generation portion 115 divides the m sets of nozzle row driving data including only the pieces of pixel data SI that is left behind after a removal of the pieces of setting data SP, and adds the n blocks of nozzle row driving data including only the pieces of pixel data SI to the upper portions of the n sets of nozzle row driving data.

Nozzle Row Driving Data Conversion Portion

Figure 10A:
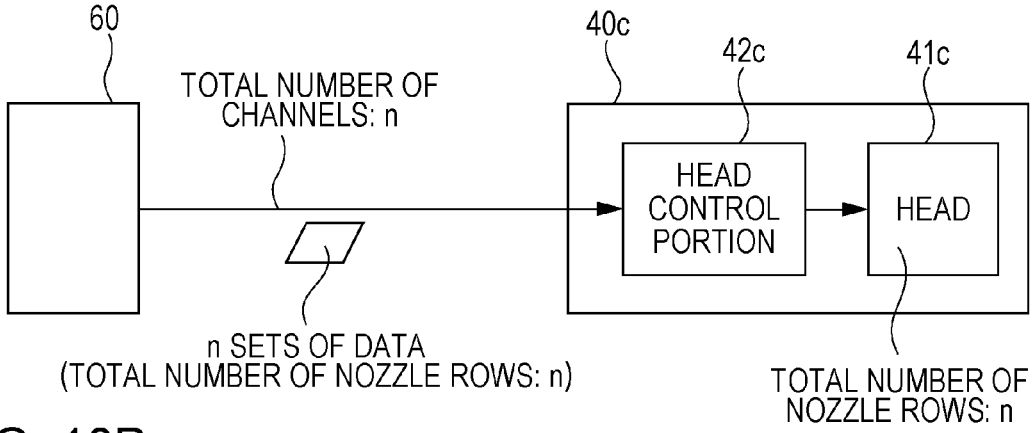
FIGS. 10A, 10B, and 10C are conceptual diagrams that describe a function of a nozzle row driving data conversion portion.
Figure 10B:
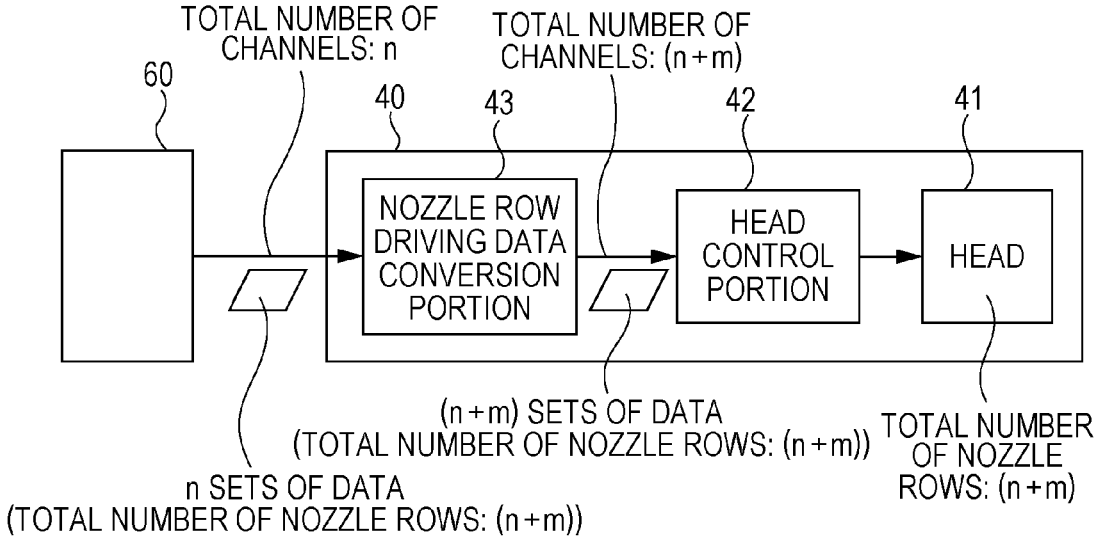
Figure 10C:
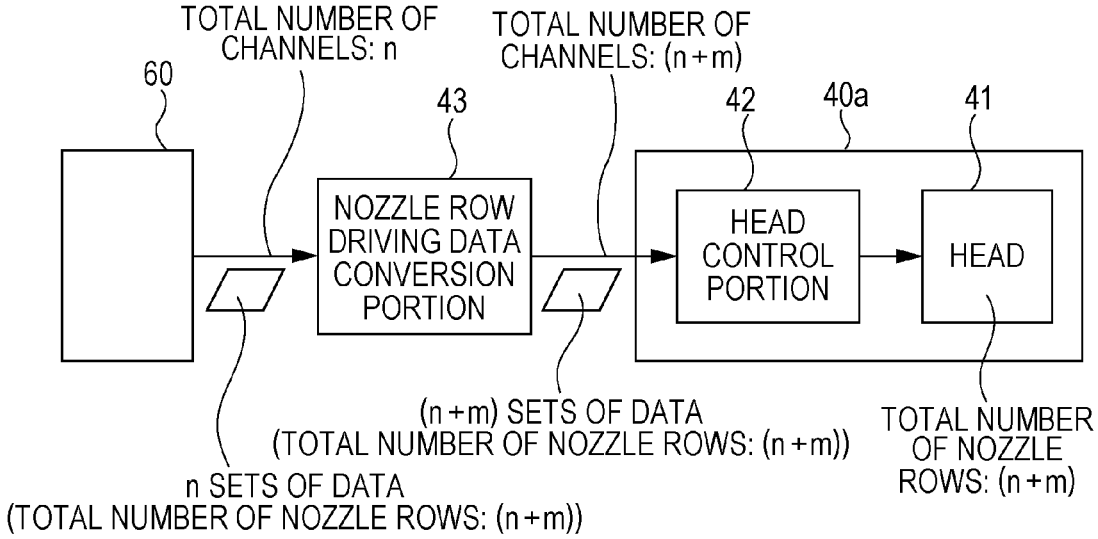

FIGS. 10A, 10B, and 10C are conceptual diagrams that describe the function of the nozzle row driving data conversion portion 43. FIG. 10A illustrates a connection relation between the controller 60 and the control portion 42*c* in an existing technology (in the case where the nozzle row driving data conversion portion 43 is not included), and FIG. 10B illustrates a connection relation between the controller 60 and the control portion 42 in this embodiment (in the case where the head unit 40 includes the nozzle row driving data conversion portion 43).

In the existing technology, in order to perform printing using the liquid droplet ejecting head 41*c* provided with n nozzle rows, n sets of nozzle row driving data has been transmitted to the head control portion 42*c* by using n channels. In contrast thereto, in this embodiment, n sets of nozzle row driving data that are associated with (n+m) nozzle rows are transmitted to the nozzle row driving data conversion portion 43 by using n channels. Further, the nozzle row driving data conversion portion 43 convers the arrangement of the received n sets of nozzle row driving data, and transmits resultant (n+m) sets of nozzle row driving data each associated with a corresponding one of the (n+m) nozzle rows to the head control portion 42 by using (n+m) channels.

In addition, it has been described above that the nozzle row driving data conversion portion 43 is included in the head unit 40 but, as shown in FIG. 10C, the nozzle row driving data conversion portion 43 may be configured so as to be independently disposed at a position where the controller 60 and the head unit 40*a* are connected to each other. Moreover, although illustration is omitted, the nozzle row driving data conversion portion 43 may be configured so as to be included in an output portion of the controller 60.

Figure 11:
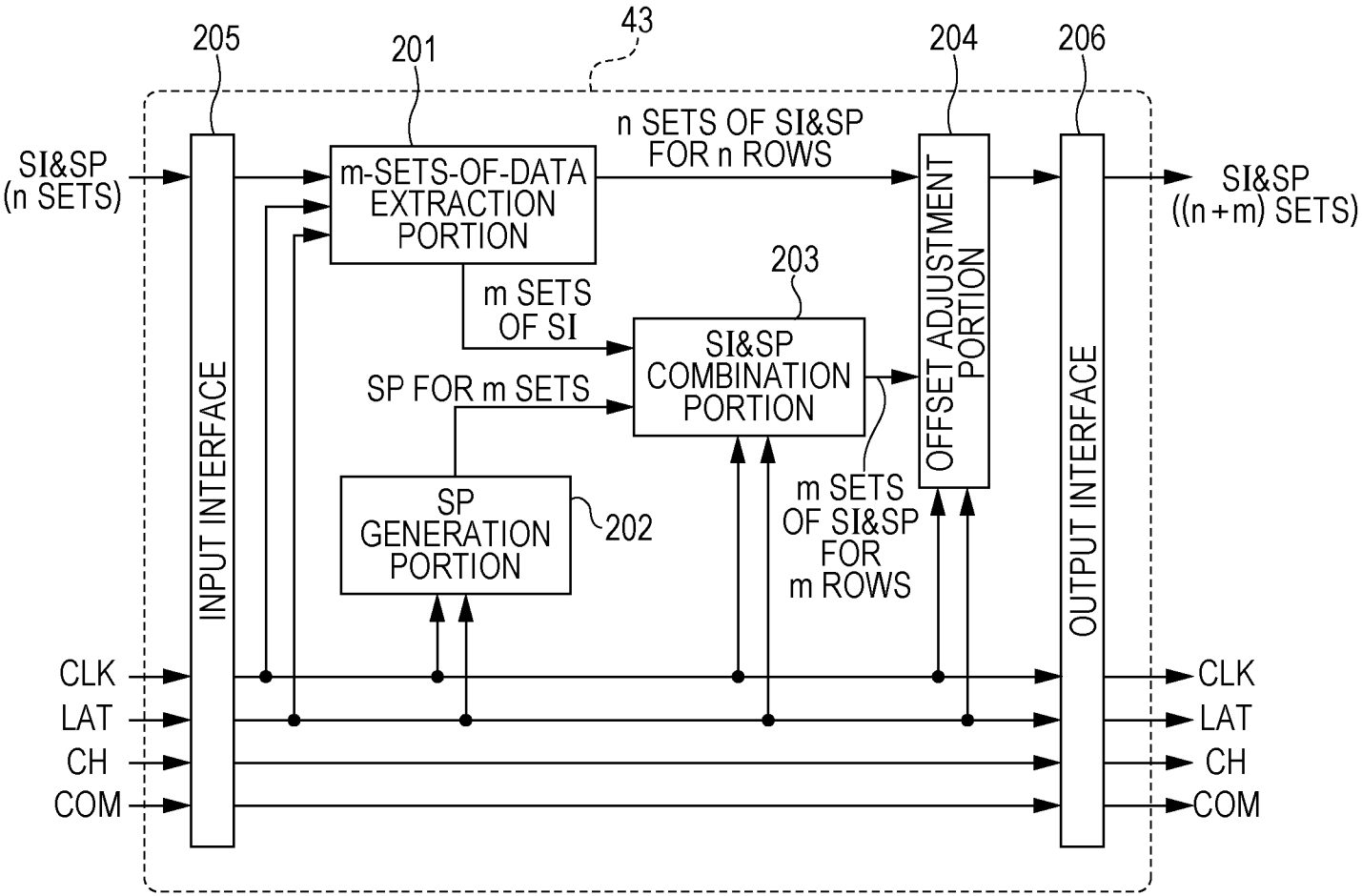
FIG. 11 is a block diagram illustrating a configuration of a nozzle row driving data conversion portion.

FIG. 11 is a block diagram illustrating a configuration of the nozzle row driving data conversion portion 43.

The nozzle row driving data conversion portion 43 is constituted by a programmable logic device as a "nozzle row driving data conversion apparatus". As the programmable logic device, a field programmable gate array (FPGA) is employed as a suitable example thereof.

The nozzle row driving data conversion portion 43 is constituted by an m-sets-of-data extraction portion 201, an SP generation portion 202, an SI & SP combination portion 203, an offset adjustment portion 204, an input interface 205, an output interface 206, and the like.

The m-sets-of-data extraction portion 201 is a circuit for extracting the m sets of nozzle row driving data, which are difficult to be transmitted via the n channels and which have been divided into the n blocks of nozzle row driving data, from the n sets of nozzle row driving data that have been received via the input interface 205, and that are illustrated in FIG. 9B and are associated with the (n+m) nozzle rows, and dividing n sets of nozzle row driving data each associated with a corresponding one of n nozzle rows and m sets of nozzle row driving data mage data each associated with a corresponding one of m nozzle rows. The m sets of nozzle row driving data each associated with a corresponding one of the m nozzle rows are constituted by only m sets of pixel data SI each associated with a corresponding one of m rows because the pieces of setting data SP have been removed when the m sets of nozzle row driving data have been divided into the n blocks of nozzle row driving data.

Figure 12:
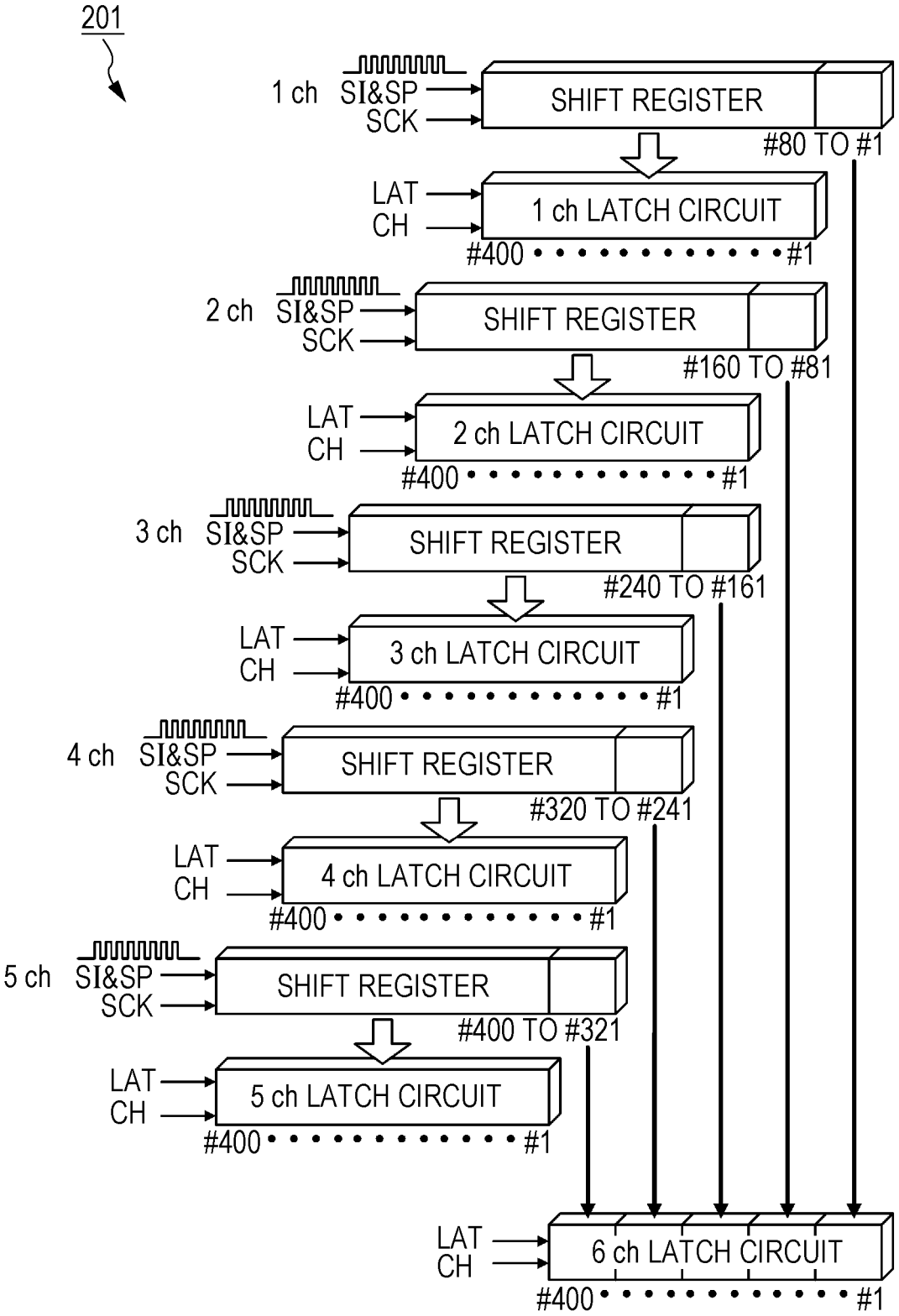
FIG. 12 is a block diagram illustrating an example of the configuration of an m-sets-of-data extraction portion.

FIG. 12 is a block diagram illustrating an example of the configuration of the m-sets-of-data extraction portion 201. FIG. 12 illustrates an example of the configuration of a circuit for a portion that, among the sets of nozzle row driving data (i.e., sets of setting signals SI and SP) 1*ch* to 12*ch* shown in FIG. 9C, reproduces sets of nozzle row driving data 1*ch* to 6*ch*. Upper portions of five sets of nozzle row driving data each having been stored in a corresponding one of shift registers 1*ch* to 5*ch* are latched into a latch circuit 6*ch* as a reproduced set of nozzle row driving data 6*ch*, and original setting signals SI & SP each having been left behind in a corresponding one of the shift registers 1*ch* to 5*ch* are each latched into a corresponding one of latch circuits 1*ch* to 5*ch*. In addition, the reproduced set of nozzle row driving data having been latched in the latch circuit 6*ch* is composed of only the pieces of pixel data SI having been left behind after the removal of the pieces of setting data SP.

Returning to explanation of FIG. 11, the SP generation portion 202 is a circuit for, in order to reproduce m sets of setting signals SI and SP, generating m sets of setting data SP each to be added to a corresponding one of the m sets of nozzle row driving data each of which is associated with a corresponding one of the m nozzle rows and which result from the removal of the m sets of setting data SP. The m sets of setting data SP to be added can be generated in a pseudo way by the SP generation unit 202.

The SI & SP combination portion 203 is a circuit for reproducing the m sets of nozzle row driving data (m sets of setting signals SI & SP) each associated with a corresponding one of the m nozzle rows by adding each of the m sets of setting data SP having been generated by the SP generation portion 202 to a corresponding one of the m sets of nozzle row driving data (resulting from the removal of the m sets of setting data SP) each being associated with a corresponding one of the m nozzle rows and having been output from the m-sets-of-data extraction portion 201.

In addition, in the case where, in the nozzle row driving data generation portion 115, the addition of each of the n blocks of nozzle row driving data resulting from the division of the m sets of nozzle row driving data that are excesses over a channel number n to a corresponding one of the n sets of nozzle row driving data is performed so as to include the m sets of setting data SP, it is unnecessary to provide the SI & SP combination portion 203.

The offset adjustment portion 204 is a final adjustment circuit for performing offset adjustment on timing points (positions) at each of which the ejection of ink droplets is executed, in accordance with a scan-direction distance between two adjacent ones of the nozzle rows (that is, in accordance with a nozzle-row pitch (refer to FIG. 4)).

Each of the sets of setting signals SI & SP constituting the set of printing data having been subjected to the rasterization processing by the printer driver is required to be transmitted at a corresponding timing point (position) in which the nozzle-row pitch is taken into account. That is, for each of the nozzle rows, an offset adjustment value exists in accordance with the scanning-direction distance between two adjacent ones of the nozzle rows. In this embodiment, however, since the sets of nozzle row driving data each associated with a corresponding one of the mutually different nozzle rows are transmitted via identical channels and individual pieces of offset adjustment value information are not added, the offset adjustment portion 204 performs offset processing that is required on the reproduced m sets of nozzle row driving data (setting signals SI & SP).

The input interface 205 is an interface circuit that inputs received signals from the controller 60 into the inside of the nozzle row driving data conversion portion 43, and that performs level conversion of some of the received signals, which require the level conversion, into signals of levels that can be subjected to internal computing processing. Incidentally, the received signals are the setting signals SI & SP, the clock signals CLK, the latch signal LAT, the change signal CH, the driving signal COM, and the like.

The output interface 206 is an interface circuit that outputs signals to the head control portion 42, and that performs level conversion of some of the output signals, which require the level conversion, into signals of levels that can be subjected to the processing by the head control portion 42. Incidentally, the signals that are transmitted to the head control portion 42 are the setting signals SI & SP, the clock signals CLK, the latch signal LAT, the change signal CH, the driving signal COM, and the like.

As described above, the nozzle row driving data conversion apparatus and the liquid droplet ejecting apparatus, according to this embodiment, bring about the following advantageous effects.

The nozzle row driving data conversion apparatus (the nozzle row driving data conversion portion 43) converts n sets of nozzle row driving data for the (n+m) rows of nozzles into (n+m) sets of nozzle row driving data for the (n+m) rows of nozzles. It becomes possible to easily change the number of nozzle rows included in the liquid droplet ejecting apparatus 1 by providing the nozzle row driving data conversion apparatus in the liquid ejecting apparatus 1. Specifically, it becomes possible to easily replace the liquid droplet ejecting head 41*c* including n nozzle rows by the liquid droplet ejecting head 41 including (n+m) nozzle rows.

Further, since each of the n sets of nozzle row driving data for the (n+m) rows of nozzles includes a corresponding one of n blocks of divided nozzle row driving data resulting from dividing m rows of nozzle row driving data, it is possible to generate m sets of nozzle row driving data each of which is associated with a corresponding one of m rows of nozzle row driving data by combining the n blocks of divided nozzle row driving data. That is, the nozzle row driving data conversion apparatus is capable of converting the n sets of nozzle row driving data for the (n+m) rows of nozzles into n sets of nozzle row driving data each of which is associated with a corresponding one of n rows of nozzle row driving data and the m sets of nozzle row driving data each of which is associated with a corresponding one of the m rows of nozzle row driving data. Further, it becomes possible to handle (n+m) rows of nozzle row driving data as n sets of nozzle row driving data at a stage anterior to the nozzle row driving data conversion apparatus (i.e., in the unit control portion 64) by providing the nozzle row driving data conversion apparatus in the liquid droplet ejecting apparatus 1. As a result, it becomes possible to easily replace a liquid droplet ejecting head including n nozzle rows by a liquid droplet ejecting head including (n+m) nozzle rows without modifying the unit control portion 64.

Further, since the nozzle row driving data conversion apparatus is configured so as to include a programmable logic device, it is possible to easily configure the nozzle row driving data conversion apparatus. Moreover, it is possible to easily change the number of the sets of nozzle row driving data. Specifically, in the case where the nozzle row driving data conversion apparatus is provided in the liquid droplet ejecting apparatus 1, it is possible to further flexibly change the number of the nozzle rows provided in the liquid droplet ejecting head 41, that is, it is possible to easily deal with the change of the number of the nozzle rows by changing the value of n and/or the value of m.

The liquid droplet ejecting apparatus 1 includes the nozzle row driving data generation portion 115 that generates (n+m) nozzle rows and n sets of nozzle row driving data for the (n+m) rows of nozzles. Further, the liquid droplet ejecting apparatus 1 includes the nozzle row driving data conversion portion 43 that converts the generated n sets of nozzle row driving data that are associated with the (n+m) rows of nozzle row driving data into (n+m) sets of nozzle row driving data each of which is associated with a corresponding one of the (n+m) rows of nozzle row driving data. Thus, the liquid droplet ejecting apparatus 1 brings about an advantageous effect in that it becomes possible to easily change the number of nozzle rows provided in the liquid droplet ejecting apparatus 1. Specifically, it becomes possible to easily replace the liquid droplet ejecting head 41*c* including n nozzle rows by the liquid droplet ejecting head 41 including (n+m) nozzle rows by making changes to the head unit 40 and a printer driver that supports the head unit 40.

It is to be noted here that the invention is not limited to the aforementioned embodiment, and various modifications and improvements can be made on the aforementioned embodiment. Some modification examples will be described blow. In modification examples described below, constituent portions that are the same as constituent portions of the aforementioned embodiment are denoted by reference signs that are the same as reference signs of the constituent portions of the aforementioned embodiment, and duplicated descriptions thereof are omitted.

Modification Example 1

Figure 13:
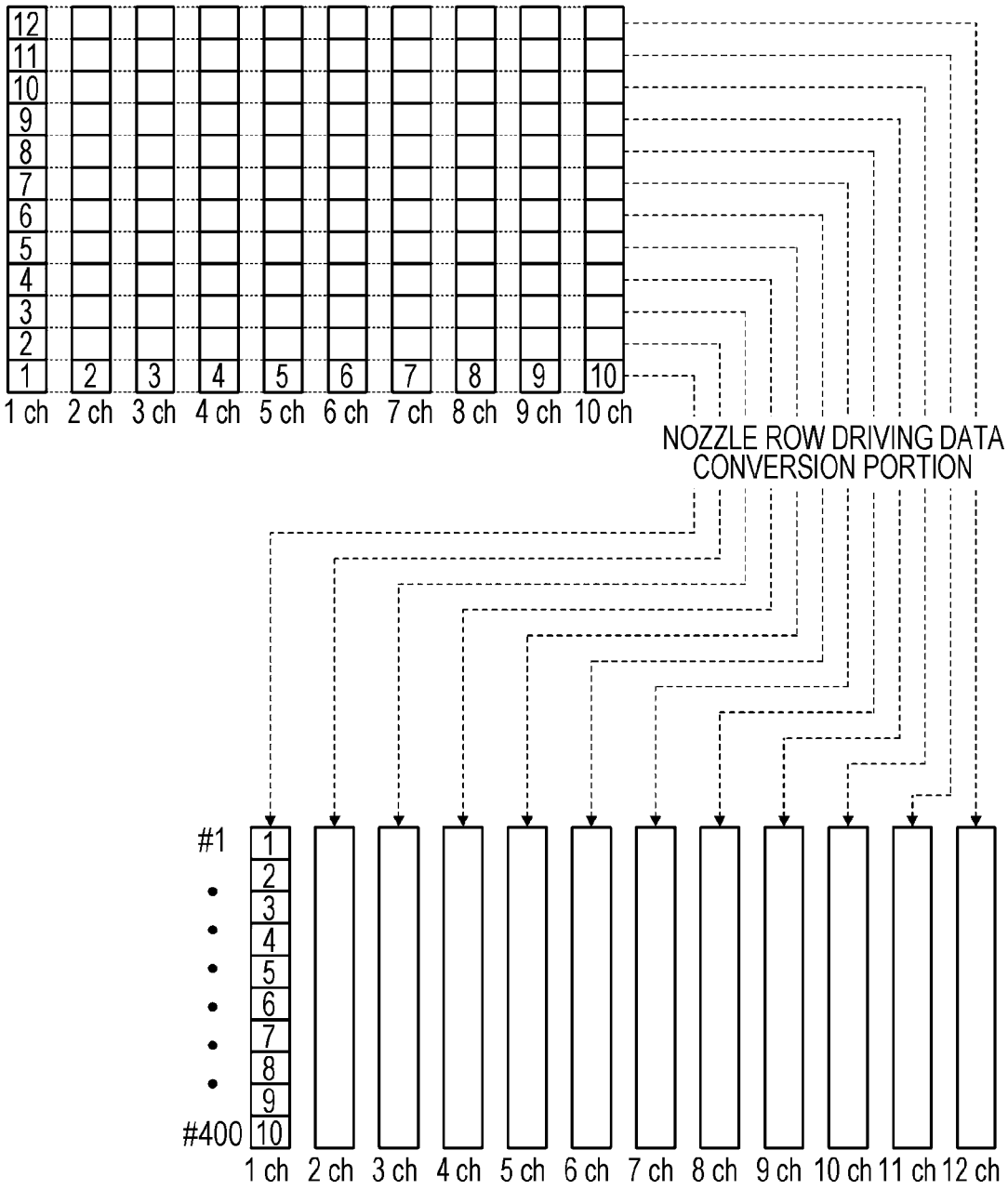
FIG. 13 is a conceptual diagram illustrating a function of a nozzle row driving data conversion portion according to a modification example.

FIG. 13 is a conceptual diagram illustrating the function of a nozzle row driving data conversion portion according to modification example 1.

In embodiment 1, it has been described a configuration in which, as shown in FIGS. 9A to 9C, n (=10) blocks of divided nozzle row driving data resulting from dividing m (=2) rows of nozzle row driving data are each included in a corresponding one of n (=10) pre-conversion rows of nozzle row driving data that are associated with (n+m) (=12) rows of nozzle row driving data, but this configuration does not limit any other appropriate configuration. Another appropriate configuration may be such that n (=10) blocks of divided nozzle row driving data resulting from dividing the (n+m) (=12) rows of nozzle row driving are each included in a corresponding one of n (=10) pre-conversion rows of nozzle row driving data that are associated with the (n+m) (=12) rows of nozzle row driving data. Hereinafter, the details of this configuration will be described.

Data rows 1*ch* to 10*ch* illustrated at the upper side of FIG. 13 are ten pre-conversion sets of nozzle row driving data that are associated with twelve rows of nozzle row driving data. Each of the data rows 1*ch* to 10*ch*, which extends in a vertical direction in FIG. 13, includes a corresponding one of ten blocks of divided nozzle row driving data resulting from dividing the twelve rows of nozzle row driving data. For the sake of simplification of the following description, it is assumed that, for example, each of sets of nozzle row driving data includes only pieces of pixel data SI. In such a case, in the data row 1*ch*, pieces of pixel data SI associated with nozzles #1 to #40 that constitute a first group of ten groups each consisting of forty nozzles resulting from dividing four hundred nozzles of each of the channels 1*ch* to 12*ch* by ten are sequentially stacked in order from the channel 1*ch* to the channel 12*ch*. In the data row 2*ch*, pieces of pixel data SI associated with nozzles #41 to #80 that constitute a second group of ten groups each consisting of forty nozzles resulting from dividing four hundred nozzles of each of the channels 1*ch* to 12*ch* by ten are sequentially stacked in order from the channel 1*ch* to the channel 12*ch*. In each of the data rows 3*ch* to 10*ch*, similarly, pieces of pixel data SI associated with forty nozzles that constitute a corresponding one of third to tenth groups of ten groups each consisting of forty nozzles resulting from dividing four hundred nozzles of each of the channels 1*ch* to 12*ch* by ten are sequentially stacked in order from the channel 1*ch* to the channel 12*ch*. This data configuration can be realized by implementing a function of performing such a division and an arrangement in the nozzle row driving data generation portion included in the printer driver.

The ten sets of nozzle row driving data having been divided in such a way as described above are transmitted via channels 1*ch* to 10*ch* and, at a receiving side, as shown at the lower side of FIG. 13, twelve data rows 1*ch* to 12*ch* (twelve sets of nozzle row driving data each for use in driving a corresponding one of twelve nozzle rows) are reproduced.

Figure 14:
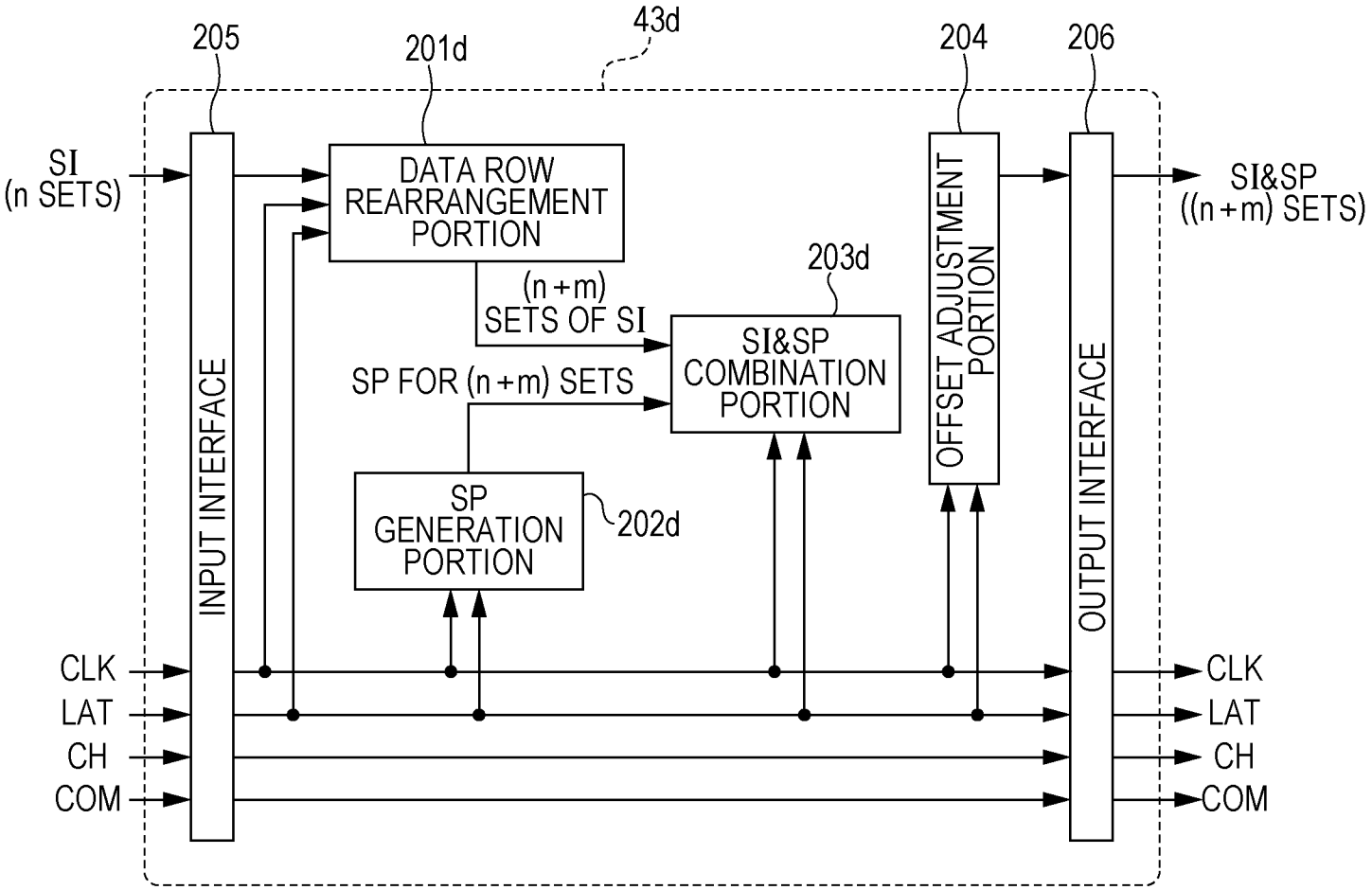
FIG. 14 is a block diagram illustrating a configuration of a nozzle row driving data conversion portion according to a modification example.

FIG. 14 is a block diagram illustrating a configuration of a nozzle row driving data conversion portion 43*d* according to modification example 1.

The nozzle row driving data conversion portion 43*d* is constituted by a data row rearrangement portion 201*d*, an SP generation portion 202*d*, an SI & SP combination portion 203*d*, an offset adjustment portion 204, an input interface 205, an output interface 206, and the like.

The data row rearrangement portion 201*d* is a circuit for rearranging n sets of nozzle row driving data (i.e., the data that is illustrated at the upper side of FIG. 13 and that is associated with (n+m) nozzle rows) into (n+m) sets of nozzle row driving data (i.e., the data that is illustrated at the lower side of FIG. 13 and that is associated with the (n+m) nozzle rows).

The SP generation portion 202*d* is a circuit for, in order to reproduce (n+m) sets of setting signals SI and SP, generating (n+m) sets of setting data SP each to be added to a corresponding one of (n+m) sets of nozzle row driving data result from removing (n+m) sets of setting data SP. In embodiment 1, in order to reproduce m sets of setting signals SI and SP data, m sets of setting data SP each to be added to a corresponding one of m sets of nozzle row driving data having been divided into n blocks of nozzle row driving data and having been reproduced are generated; while, in this modification example, in order to reproduce (n+m) sets of setting signals SI and SP, (n+m) sets of setting data SP each to be added to a corresponding one of (n+m) sets of nozzle row driving data result from removing (n+m) sets of setting data SP are generated.

The SI & SP combination portion 203*d* is a circuit for reproducing (n+m) sets of nozzle row driving data (setting signals SI & SP) each associated with a corresponding one of (n+m) nozzle rows by adding each of the (n+m) sets of setting data SP, which have been generated by the SP generation portion 202*d*, to a corresponding one of the (n+m) sets of setting signals SI, which have been rearranged by the data row rearrangement portion 201*d*.

According to the nozzle row driving data conversion portion 43*d* in this modification example, in such a way as described above, it becomes possible to easily replace a liquid droplet ejecting head including n nozzle rows by a liquid droplet ejecting head including (n+m) nozzle rows just like in the case of embodiment 1. Further, it is possible to realize a conversion from (n+m) sets of nozzle row driving data into n sets of nozzle row driving data and a conversion from n sets of nozzle row driving data into (n+m) sets of nozzle row driving data by employing a circuit configuration that allows substantially the same processing on pieces of data corresponding to each of (n+m) nozzle rows, and thus, it is possible to make the configuration the nozzle row driving data conversion portion 43*d* simpler.

The aforementioned methods are methods in which nozzle driving data is handled in a unit of nozzle row, but the invention is not limited to this method. The invention can be also applied to a method in which the nozzle driving data is handled in a unit of printing head, a method in which the nozzle driving data is handled in a unit of nozzle, and a method in which the nozzle driving data is handled in a unit of predetermined nozzle group. In this case, the conversion of the nozzle driving data can be made by substituting a unit of handling the nozzle driving data from the nozzle row to any one of the head, the nozzle, and the predetermined nozzle group.

The entire disclosure of Japanese Patent Application No. 2014-211449, filed Oct. 16, 2014 is expressly incorporated by reference herein.

What is claimed is:

1. A nozzle row driving data conversion apparatus configured to convert n sets of nozzle row driving data for (n+m) rows of nozzles into (n+m) sets of nozzle row driving data for the (n+m) rows of nozzles.

2. The nozzle row driving data conversion apparatus according to claim 1, wherein the n sets of nozzle row driving data for the (n+m) rows of nozzles includes nozzle row driving data resulting from dividing m rows of nozzle row driving data into n blocks.

3. The nozzle row driving data conversion apparatus according to claim 1, wherein the n sets of nozzle row driving data for the (n+m) rows of nozzles includes nozzle row driving data resulting from dividing each of the (n+m) rows of nozzle row driving data into n blocks.

4. The nozzle row driving data conversion apparatus according to claim 1, wherein the nozzle row driving data conversion apparatus includes a programmable logic device.

5. A liquid droplet ejecting apparatus comprising:

(n+m) nozzle rows including a plurality of nozzles through which liquid droplets are ejected onto a printing medium; and a nozzle row driving data conversion portion configured to convert n sets of nozzle row driving data for the (n+m) rows of nozzles, the data being used in driving the nozzle rows, into (n+m) sets of nozzle row driving data for the (n+m) rows of nozzles.

6. The liquid droplet ejecting apparatus according to claim 5, wherein the n sets of nozzle row driving data for the (n+m) rows of nozzles includes nozzle row driving data resulting from dividing m rows of nozzle row driving data into n blocks.

7. The liquid droplet ejecting apparatus according to claim 5, wherein the n sets of nozzle row driving data for the (n+m) rows of nozzles includes nozzle row driving data resulting from dividing each of the (n+m) rows of nozzle row driving data into n blocks.

8. The liquid droplet ejecting apparatus according to claim 5, wherein the nozzle row driving data conversion portion includes a programmable logic device.

* * * * *